US011527861B2

(12) United States Patent
Hwang et al.

(10) Patent No.: US 11,527,861 B2
(45) Date of Patent: Dec. 13, 2022

(54) METHOD OF ASSEMBLING CONTACTS INTO HOUSING VIA RESPECTIVE CONTACT CARRIERS DISCRETE FROM ONE ANOTHER

(71) Applicants: FOXCONN (KUNSHAN) COMPUTER CONNECTOR CO., LTD., Kunshan (CN); FOXCONN INTERCONNECT TECHNOLOGY LIMITED, Grand Cayman (KY)

(72) Inventors: Tzu-Yao Hwang, New Taipei (TW); Han-Hung Huang, New Taipei (TW); Shan-Yong Cheng, New Taipei (TW); Ming-Lun Szu, New Taipei (TW)

(73) Assignees: FOXCONN (KUNSHAN) COMPUTER CONNECTOR CO., LTD., Kunshan (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 17/020,851

(22) Filed: Sep. 15, 2020

(65) Prior Publication Data

US 2021/0075178 A1 Mar. 11, 2021

Related U.S. Application Data

(63) Continuation-in-part of application No. 16/584,967, filed on Sep. 27, 2019, now Pat. No. 10,886,655, and (Continued)

(30) Foreign Application Priority Data

Aug. 8, 2018 (CN) ..... 201810894938.0

(51) Int. Cl.
*H01R 43/20* (2006.01)
*H01R 12/71* (2011.01)
(Continued)

(52) U.S. Cl.
CPC ..... *H01R 43/20* (2013.01); *H01R 12/716* (2013.01); *H01R 13/506* (2013.01); *H01R 13/5213* (2013.01)

(58) Field of Classification Search
CPC ..... H01R 12/716; H01R 12/52; H01R 12/57; H01R 12/707; H01R 13/2442; H01R 13/506; H01R 43/16; H01R 43/20
See application file for complete search history.

(56) References Cited

U.S. PATENT DOCUMENTS 5,100,338 A * 3/1992 Lu ..... H01R 12/57 439/326
6,652,329 B1 11/2003 Hai
(Continued)

FOREIGN PATENT DOCUMENTS

CN 1261215 7/2000
CN 1362763 A 8/2002
(Continued)

*Primary Examiner* — Oscar C Jimenez
(74) *Attorney, Agent, or Firm* — Ming Chieh Chang

(57) ABSTRACT

A method of making an electrical connector includes steps of providing an insulative housing with a plurality of passageways; providing a plurality of contacts associated with corresponding carriers unitarily formed thereon, respectively; providing an external fixture discrete from the carriers; retaining the carriers on the external fixture; downwardly moving the external fixture to insert the contacts into the corresponding passageways to reach their final positions in the vertical direction, simultaneously; and removing the carriers from the corresponding contacts, respectively.

6 Claims, 37 Drawing Sheets

Related U.S. Application Data a continuation-in-part of application No. 16/530,920, filed on Aug. 2, 2019, now Pat. No. 10,777,929.

(60) Provisional application No. 62/739,160, filed on Sep. 29, 2018.

(51) Int. Cl.
*H01R 13/506* (2006.01)
*H01R 13/52* (2006.01)

(56) References Cited

U.S. PATENT DOCUMENTS 7,074,048 B2 7/2006 Hai
7,497,743 B2 * 3/2009 Tsai ..... H01R 13/2442 439/862
8,235,734 B2 * 8/2012 Ju ..... H01R 12/57 439/83
8,998,623 B2 4/2015 Hai
9,214,764 B2 12/2015 Hai
10,116,079 B1 * 10/2018 Ju ..... H01R 13/2442
10,777,929 B2 * 9/2020 Hwang ..... H01R 43/16
11,139,593 B2 * 10/2021 Ho ..... H01R 4/20
2002/0048954 A1 4/2002 Zhou
2005/0250367 A1 * 11/2005 Scholz ..... H01R 12/707 439/342
2011/0256780 A1 * 10/2011 Peng ..... H01R 12/55 439/676
2012/0100758 A1 4/2012 Hai
2014/0345134 A1 * 11/2014 Zebhauser ..... H01R 43/02 29/884
2018/0175538 A1 6/2018 Wu et al.
2018/0375243 A1 12/2018 Hsu
2019/0089098 A1 3/2019 Cheng et al.
2020/0106203 A1 * 4/2020 Hwang ..... H01R 13/2442

FOREIGN PATENT DOCUMENTS

CN 101119007 A 2/2008
CN 201319419 Y 9/2009
CN 102456958 A 5/2012
CN 202423633 U 9/2012

* cited by examiner

5

5

5

METHOD OF ASSEMBLING CONTACTS INTO HOUSING VIA RESPECTIVE CONTACT CARRIERS DISCRETE FROM ONE ANOTHER

BACKGROUND OF THE DISCLOSURE

1. Field of the Disclosure

The invention relates to the electrical connector for use with the CPU (Central Processing Unit), and particularly to the electrical connector equipped with the contacts in matrix wherein the contacts are assembled into the housing via corresponding respective contact carriers, which are not unified together and will be removed from the contacts, with a common fixture holding such discrete contact carriers of the contacts.

2. Description of Related Arts

The traditional socket for retaining the CPU are shown in U.S. Patent Application Publication No. 2018/0175538, U.S. Pat. Nos. 9,214,764, 8,998,623 with therein the relatively great amount contacts, i.e., more than three thousand contacts. The structures of the housing and the corresponding contacts can be referred to the U.S. patent application Ser. Nos. 16/014,519 filed on Jun. 21, 2018, 16/134,928 filed on Sep. 18, 2018 for the earlier U.S. Pat. No. 7,074,048. Anyhow, because the amount of the contacts is inevitably increased for performing the high speed and high frequency transmission and the minimum normal force is required between the conductive pads of the CPU and the contacts respectively, the total loading force of the CPU upon the socket becomes incredibly large. Notably, in the traditional CPU socket all the contacts, which respectively perform different functions, i.e., signal transmission, power delivering and grounding, are essentially of the same type and arranged in matrix. It is also noted that the contacting normal force between the signal contact of the socket and the corresponding conductive pad of the CPU may be relatively important compared with that between the power contact of the socket and the corresponding conductive pad of the CPU. Therefore, a new arrangement the contacts of the electrical connector to lower the total loading force of the CPU is one approach of the future trend. Some attempts have been made by installing two different type contacts in one socket for performing signal transmission and power delivery, respectively.

As shown in U.S. Pat. No. 9,142,932, the electrical connector includes an insulative housing with a plurality of passageways therein, and a plurality of contacts respectively retained in the corresponding passageways with the corresponding contacting sections extending above the top surface of the housing. Understandably, the contacts are required to be assembled or inserted into the corresponding passageways via a contact carrier having a linking part which each contact is originally linked to and successively removed from after the contact has been inserted into the corresponding passageway in the final/correct position. In other words, during assembling the contact carrier is initially held by an assembling tool to simultaneously push the same row contacts into the corresponding passageways to reach their final/correct position and is successively removed from the contacts by breaking away from the corresponding linking parts of such contacts via simultaneously back-and-forth swinging about connecting edges of the linking parts. Because the resilient contacting sections of the contacts are required to be exposed above the top surface of the housing, the contacts are required to be downwardly assembled into the corresponding passageways via the carrier which is linked on the linking part of the contacts above the top surface of the housing. Understandably, the linking edge of the linking part is essentially flush with the top surface of the housing for facilitating such a back-and-forth swinging. It is because on one hand the linking part of the contact which is linked to the carrier, is not expected to be significantly exposed above the top surface of the housing after the carrier is removed therefrom, and on the other hand it is impossible to efficiently back and forth swing the carrier if the lining edges of the linking parts are relatively located below the top surface of the housing.

SUMMARY OF THE DISCLOSURE

Accordingly, one object of the present disclosure is to provide an electrical connector for use with the LGA (Land Grid Array) CPU, which may include a relatively large contact amount while still allowing a relatively low loading force of the CPU.

To achieve the above object, in a first example, an electrical connector includes an insulative housing with a plurality of contacts retained therein in matrix wherein all the contacts are of the cantilevered spring arm type for connecting to the conductive pads of the CPU while categorized with at least two different types for performing different functions, i.e., signal transmission or power delivery. The different type may be related to the corresponding dimension/thickness, the configuration/position, the material, and the processing method which alters the mechanical or electrical characters of the contacts, etc. The different type contacts having the contact points initially at different heights while eventually at the same height, is another feature of the invention. Understandably, because of the different type contacts, the method of assembling the contacts into the housing of the socket may be changed in comparison with that in the traditional socket which has only one type contacts therein. The feature of the invention is to provide an external fixture to hold/retain contact carriers of the contacts, and commonly move the contacts downwardly into the housing to reach their final positions in the housing, wherein the carriers of the contacts, which are not unified together but being discrete from one another, will be removed from the corresponding contacts after the contacts are essentially retainably assembled within the housing.

To achieve the similar purpose, in a second example, an electrical connector includes an insulative housing having opposite top and bottom surfaces thereof and formed with a plurality of passageways arranged in matrix and extending through both the top surface and bottom surface in the vertical direction, and a plurality of contacts assembled and retained in the corresponding passageways, respectively. Each contact has a main body, a secondary body sidewardly connected to and angled with the main body in a top view. A resilient contacting section upwardly extends from an upper portion of the main body and above the top surface of the housing for contacting an electronic package having the pads thereon, and a soldering section extends from a lower portion of the secondary body around the bottom surface of the housing for mounting to a printed circuit board. The main body includes an upper linking part originally linked to an upper carrier, and further a lower linking part which is originally linked to a lower carrier. The main body includes retaining structures for retaining the contact within the passageways without moving. During assembling the contacts into the corresponding passageways, the crossbar of the lower carrier should be removed firstly so only the discrete linking legs of the first carrier remain to connect to the corresponding lower linking parts of the corresponding contacts. Via an upper assembling tool applied upon the upper carrier to bring about a downward pushing effect, the contacts commonly linked by the same upper carrier, are simultaneously inserted downwardly into the corresponding passageways from the top surface of the housing to an initial upper position. The upper carrier including the crossbar and the lining legs, is successively removed from the corresponding upper linking parts of the contacts via an operation of back and forth swinging. A lower assembling tool is further applied upon the lower linking parts of the contacts to bring about a downward pulling effect so as to move the contacts from the initial upper positions to a final lower positions. Finally, the linking legs of the lower carrier are removed from the lower linking parts of the corresponding contacts via another operation of back and forth swinging. Similar to the first example, the contacts are forced to be downwardly move toward the housing and to be assembled into the housing via the downward forces applied upon the lower linking parts of the contacts which are discrete from one another and will be removed from the corresponding contacts after the contacts are retainably assembled within the housing.

DETAILED DESCRIPTION OF THE PREFERRED EMBODIMENT

Figure 1A:
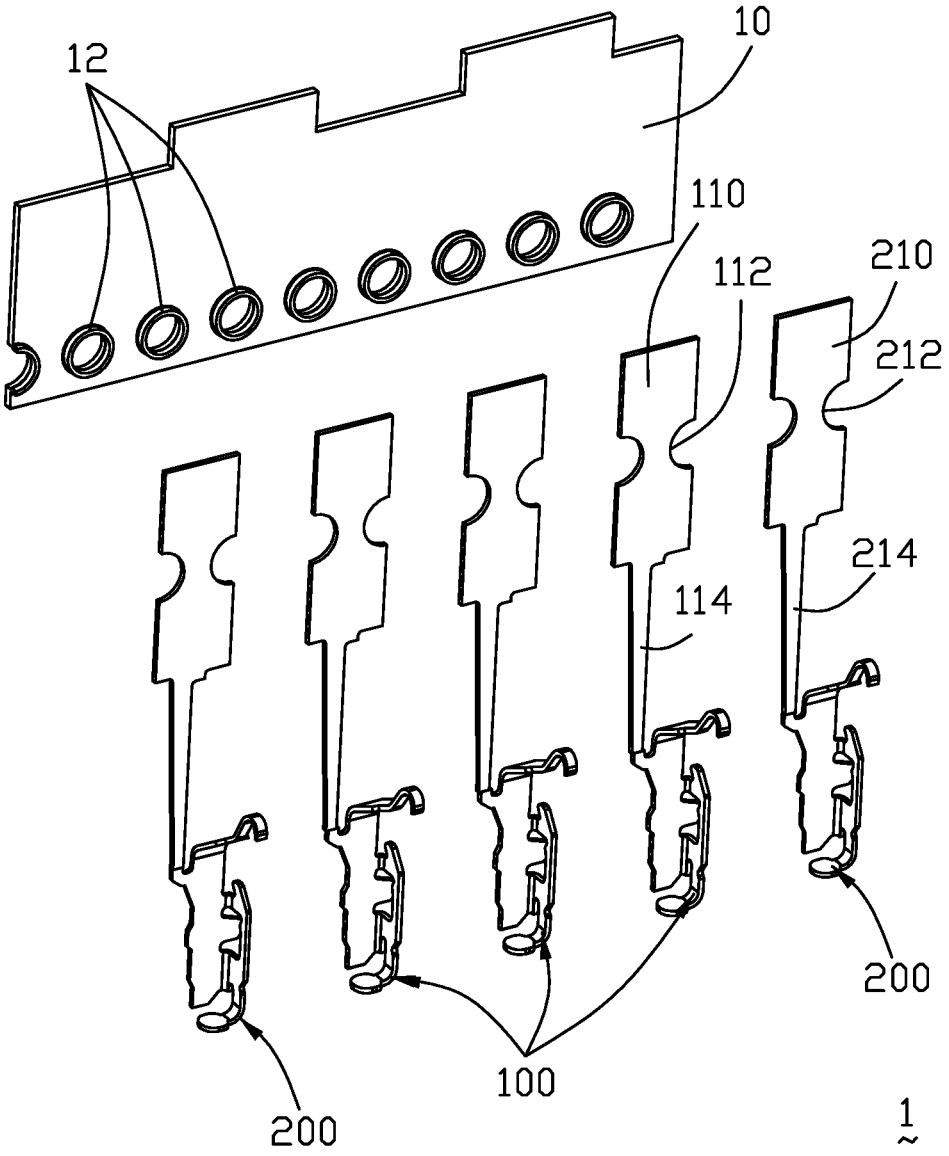
FIG. 1(A) is an exploded perspective view of a contact assembly according to a first embodiment of the invention.
Figure 1B:
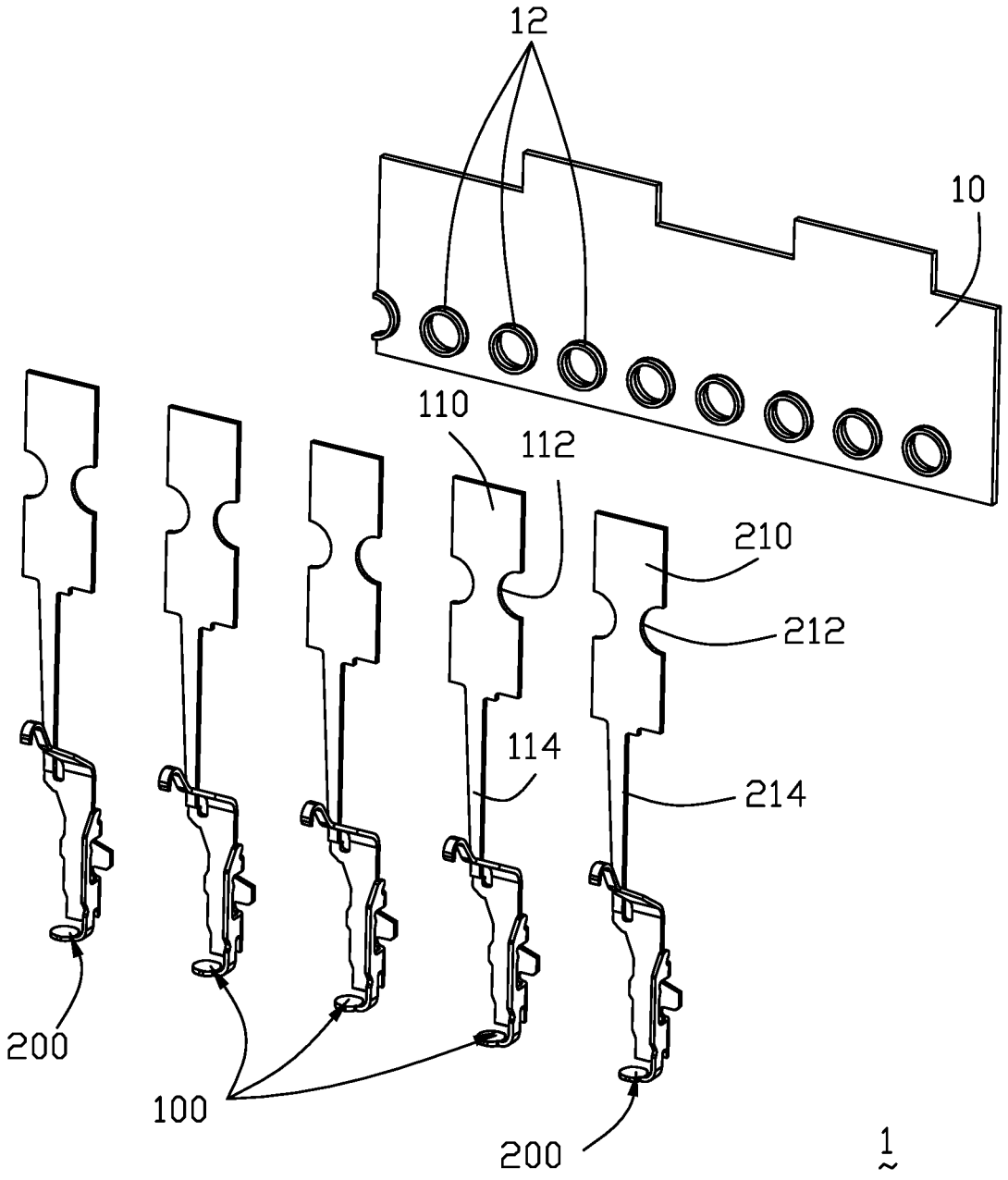
FIG. 1(B) is another exploded perspective view of the contact assembly of FIG. 1(A)
Figure 2A:
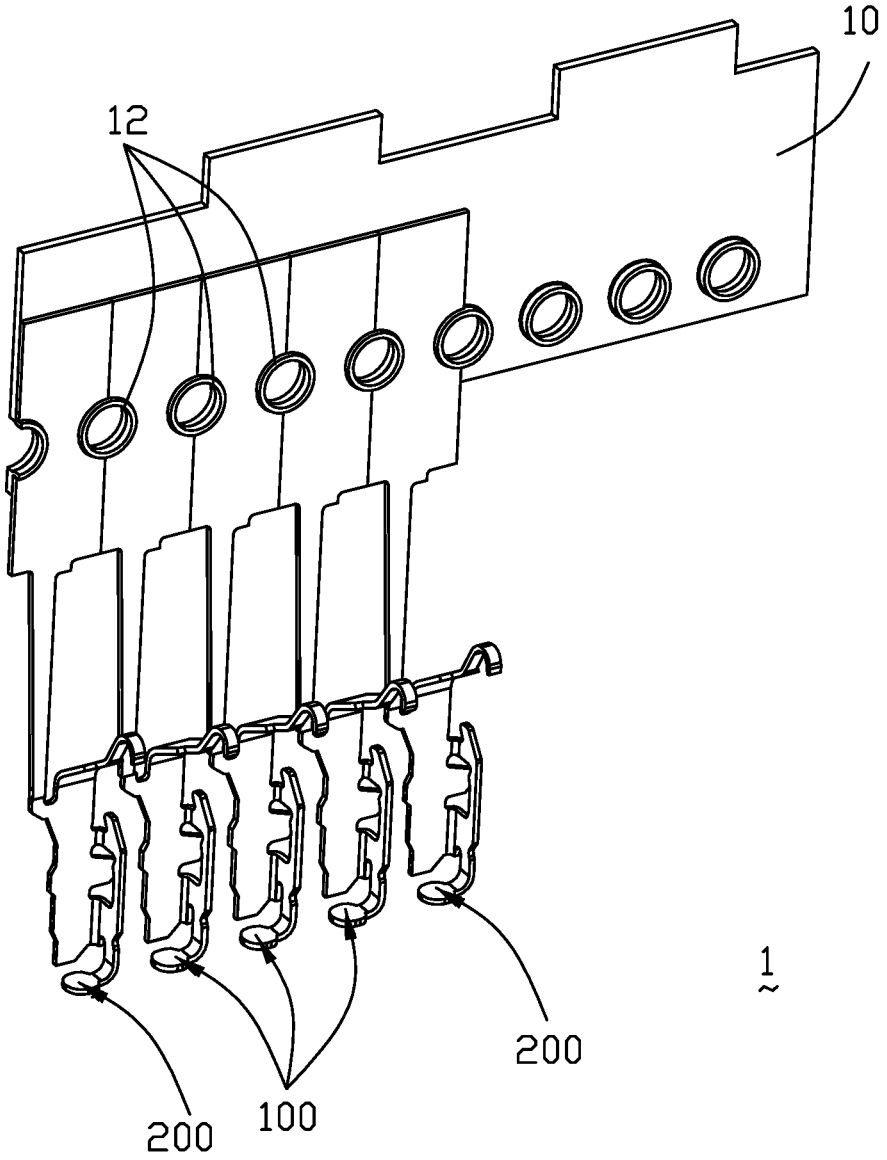
FIG. 2(A) is an assembled perspective view of the contact assembly of FIG. 1(A)
Figure 2B:
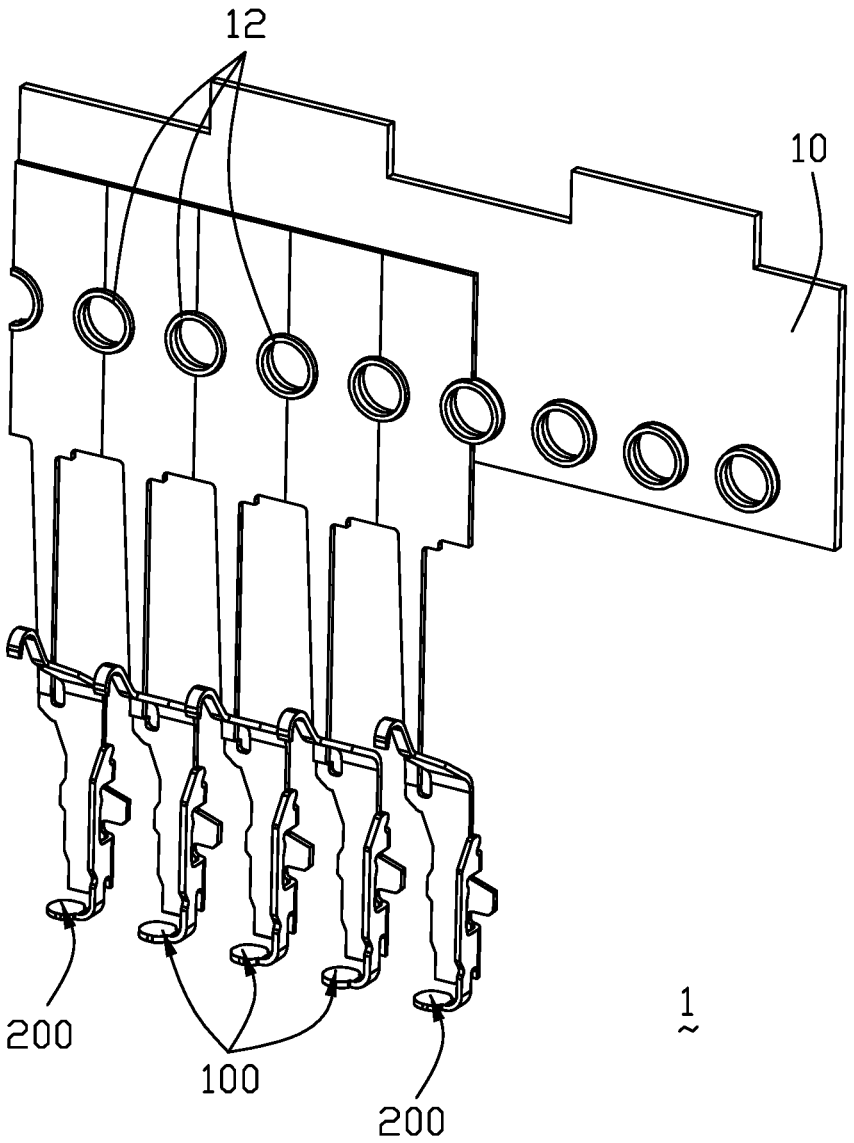
FIG. 2(B) is another assembled perspective view of the contact assembly of FIG. 2(A)
Figure 3:
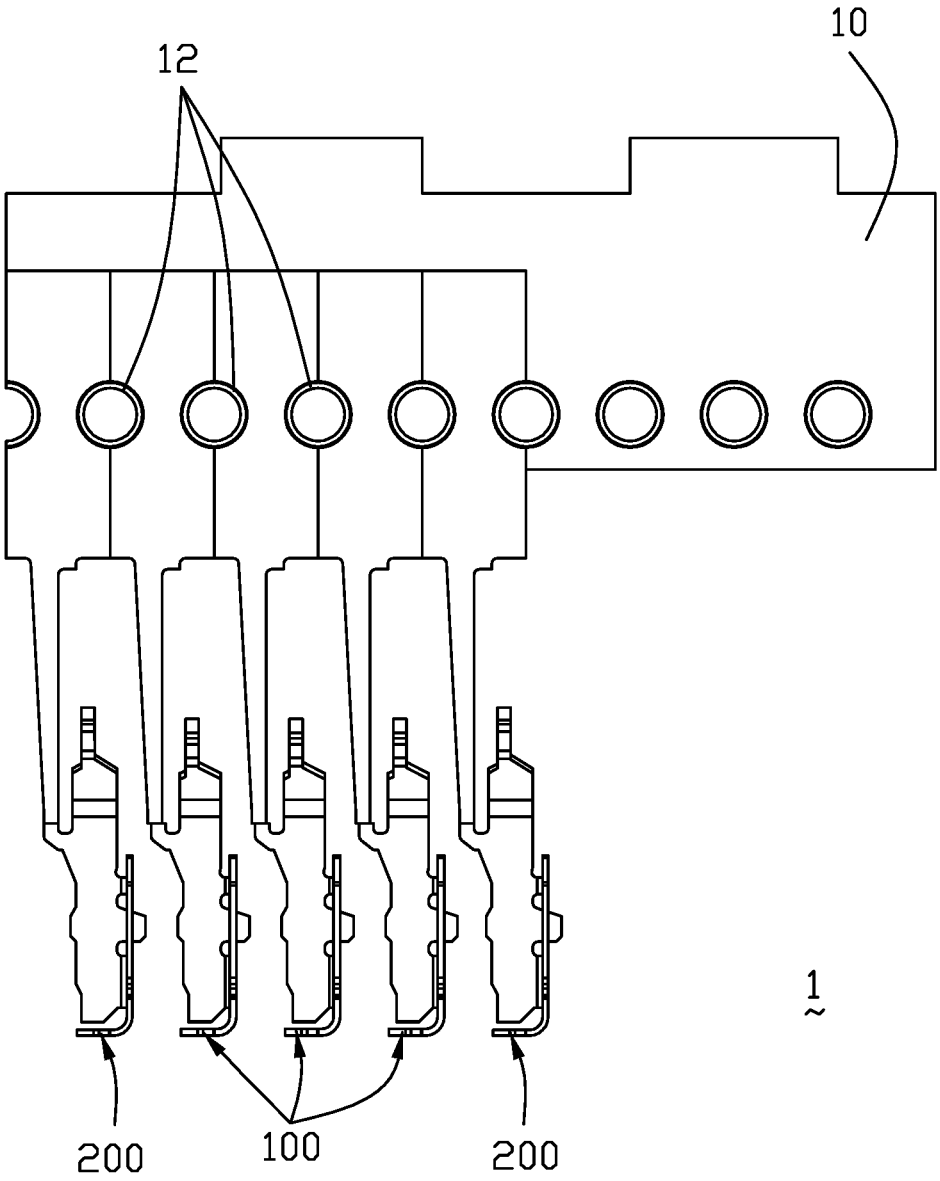
FIG. 3 is an elevational view of the contact assembly of FIG. 2.
Figure 4:
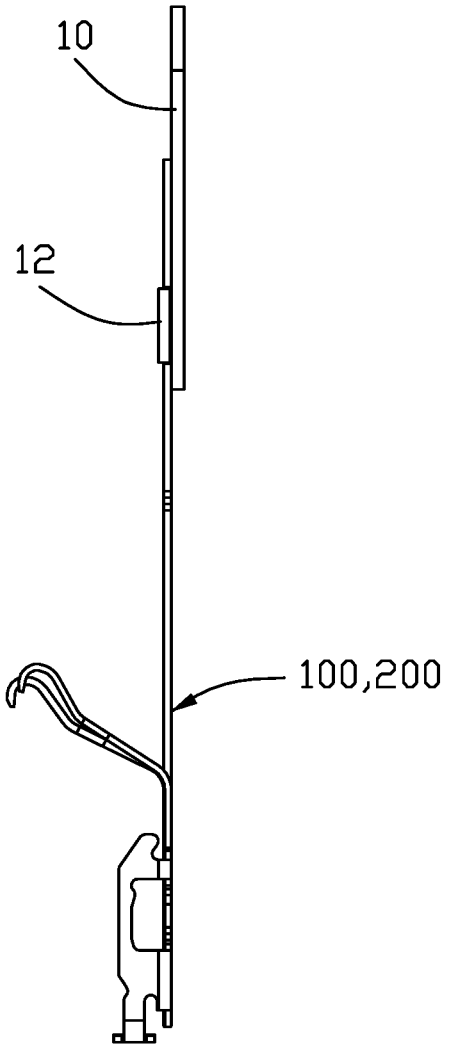
FIG. 4 is a side view of the contact assembly of FIG. 2.
Figure 5A:
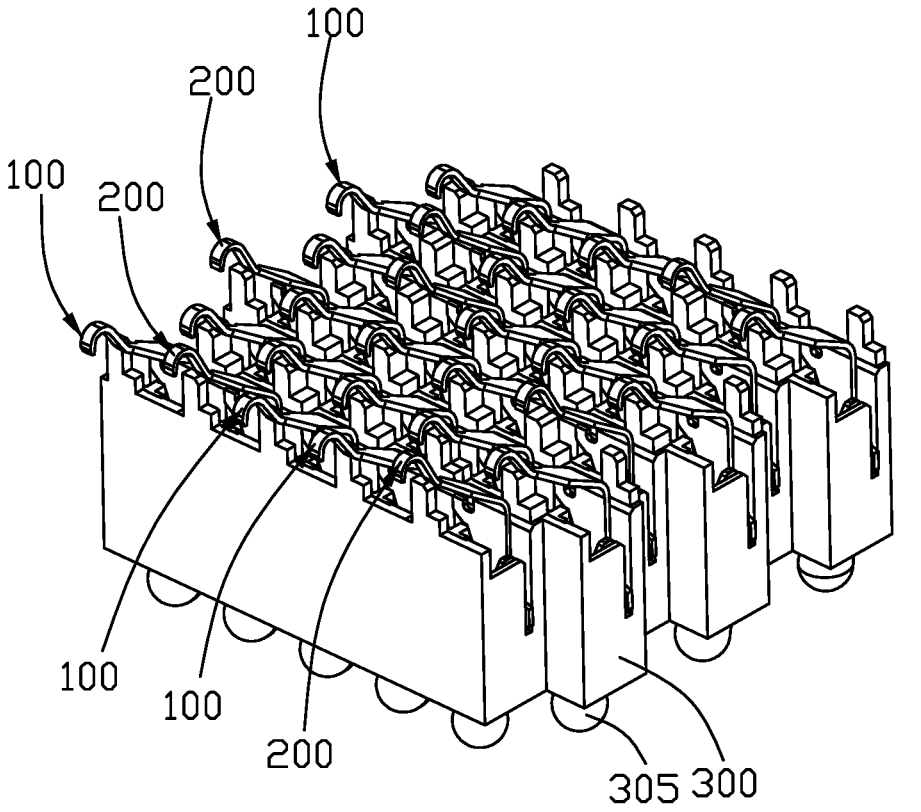
FIG. 5(A) is an assembled perspective view of the electrical connector with the corresponding contacts of FIG. 1(A)
Figure 5B:
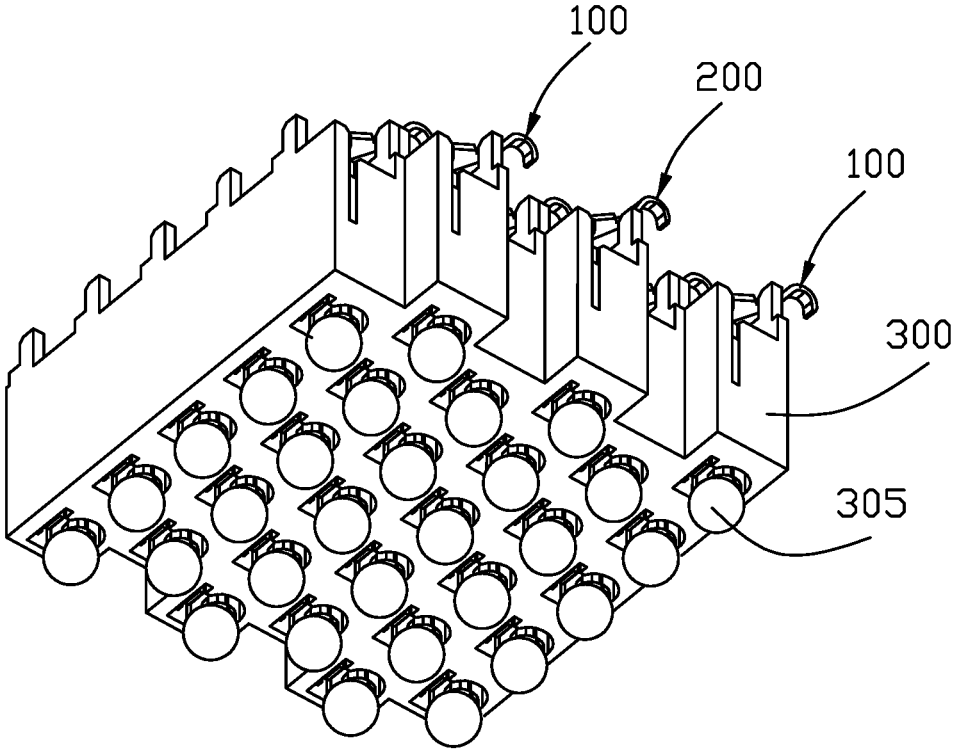
FIG. 5(B) is another assembled perspective view of the electrical connector of FIG. 5(A)
Figure 6:
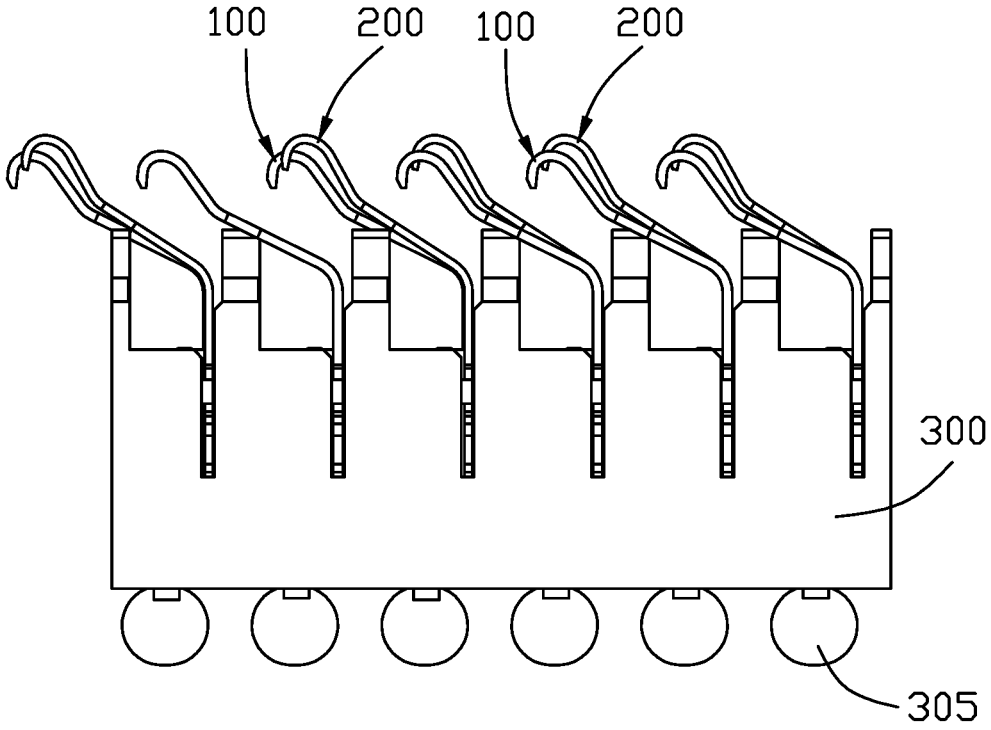
FIG. 6 is a side view of the electrical connector of FIG. 5(A)

Referring to FIGS. 1(A)-10(B), an electrical connector 5 includes an insulative housing 300 with a plurality of passageways 310 arranged in matrix and extending through opposite top and bottom surfaces of the housing 300. Each passageway 310 further includes a through type retention slot 320 and a step type retention slot 330 on two sides in a transverse direction. The housing 300 further forms a plurality of upstanding posts 340 for separating the spring arms of the contacts when the spring arms is pressed downwardly by the CPU.

A plurality of first contacts with the first type and a plurality of second contacts with the second type are disposed in the corresponding passageways 310, respectively. The first contact is originally linked with the corresponding carrier or holding part 110 totally with the reference numeral 100 which refers to the so-called first contact assembly. The first contact includes a first main body 120 with corresponding first retention barbs 130, 132 on two sides to be engaged within the corresponding retention slots 330, 320, respectively. A first spring arm 124 extends upwardly and obliquely from an upper end of the first main body 120 with a first contacting section 126 around a free end thereof. A first auxiliary body 122 extends from a side edge of the first main body 120 with a first soldering pad 128 at the lower end. A solder ball 305 is attached on an undersurface of the first soldering pad 128. The first carrier 110 has a first extension 114 linked with an upper end of the first main body 120 and a first holding section 112 secured to the corresponding holding ring 12 of the fixture or assembling part 10 for assembling the first contact into the corresponding passageway 310.

Similarly, the second contact is originally linked with the second carrier 210 totally with the reference numeral 200 which refers to the so-called second contact assembly. The second contact includes a second main body 220 with corresponding second retention barbs 230, 232 on two sides to be engaged within the corresponding retention slots 330, 320, respectively. A second spring arm 224 extends upwardly and obliquely from an upper end of the second main body 220 with a second contacting section 226 around a free end thereof. A second auxiliary body 222 extends from a side edge of the second main body 220 with a second soldering pad 228 at the lower end. A solder ball 305 is attached on an undersurface of the second soldering pad 228. The second carrier 210 has a second extension 214 linked with an upper end or edge E of the second main body 220 and a second holding section 212 secured to the corresponding holding ring 12 of the fixture 10 for assembling the second contact into the corresponding passageway 310.

Figure 7A:
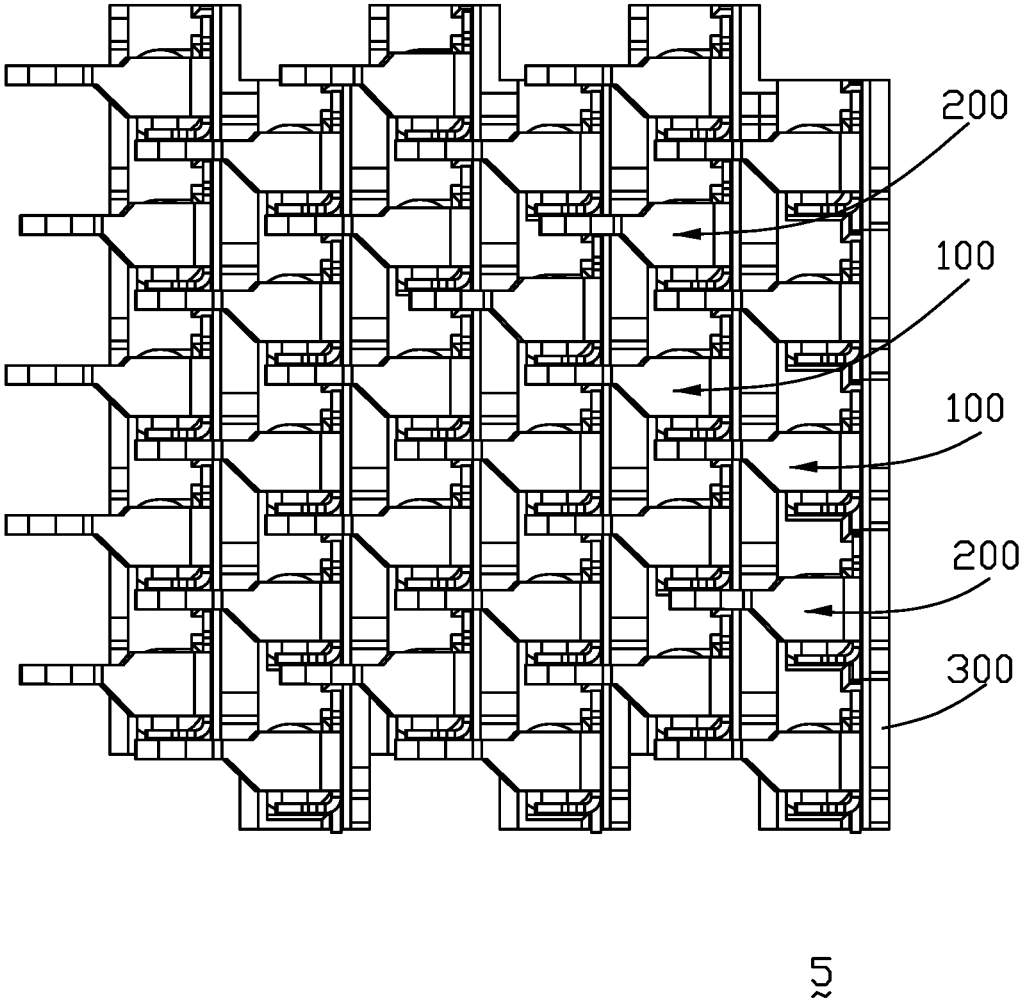
FIG. 7(A) is a top view of the electrical connector of FIG. 5(A)
Figure 7B:
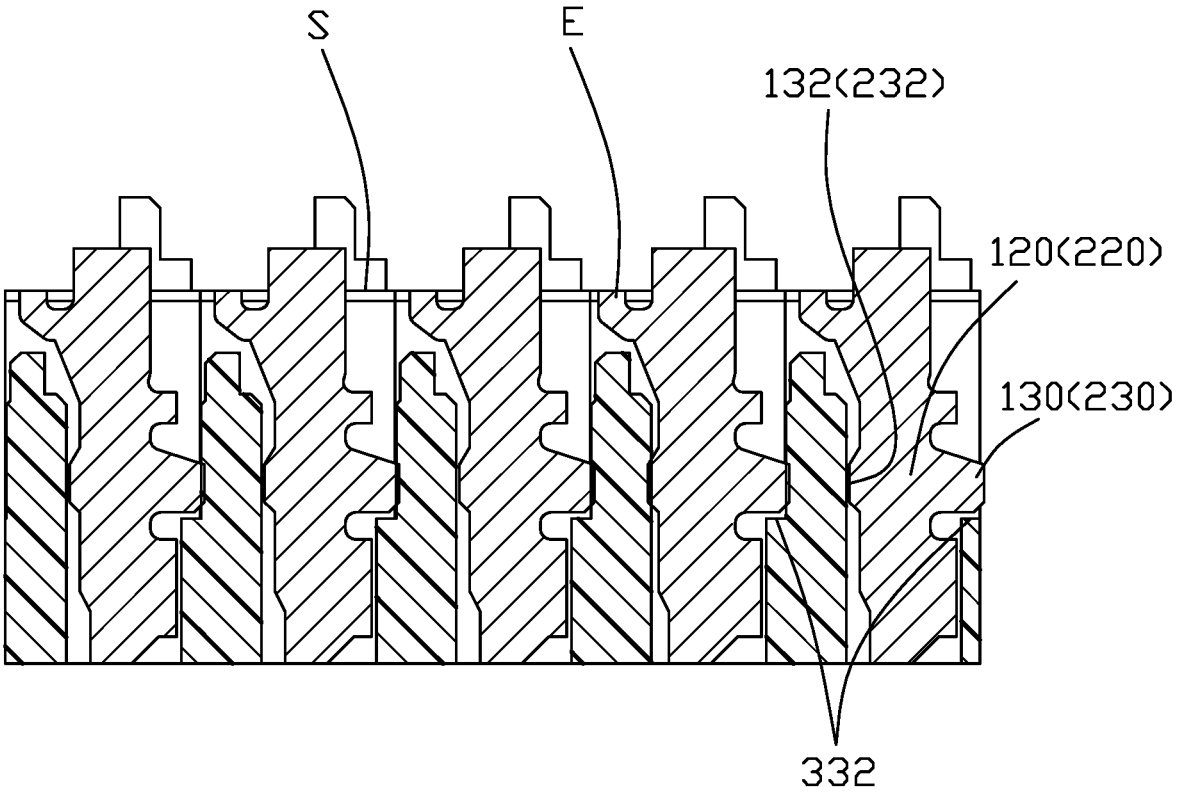
FIG. 7(B) is a cross-sectional view of the electrical connector of FIG. 5(A)
Figure 7C:
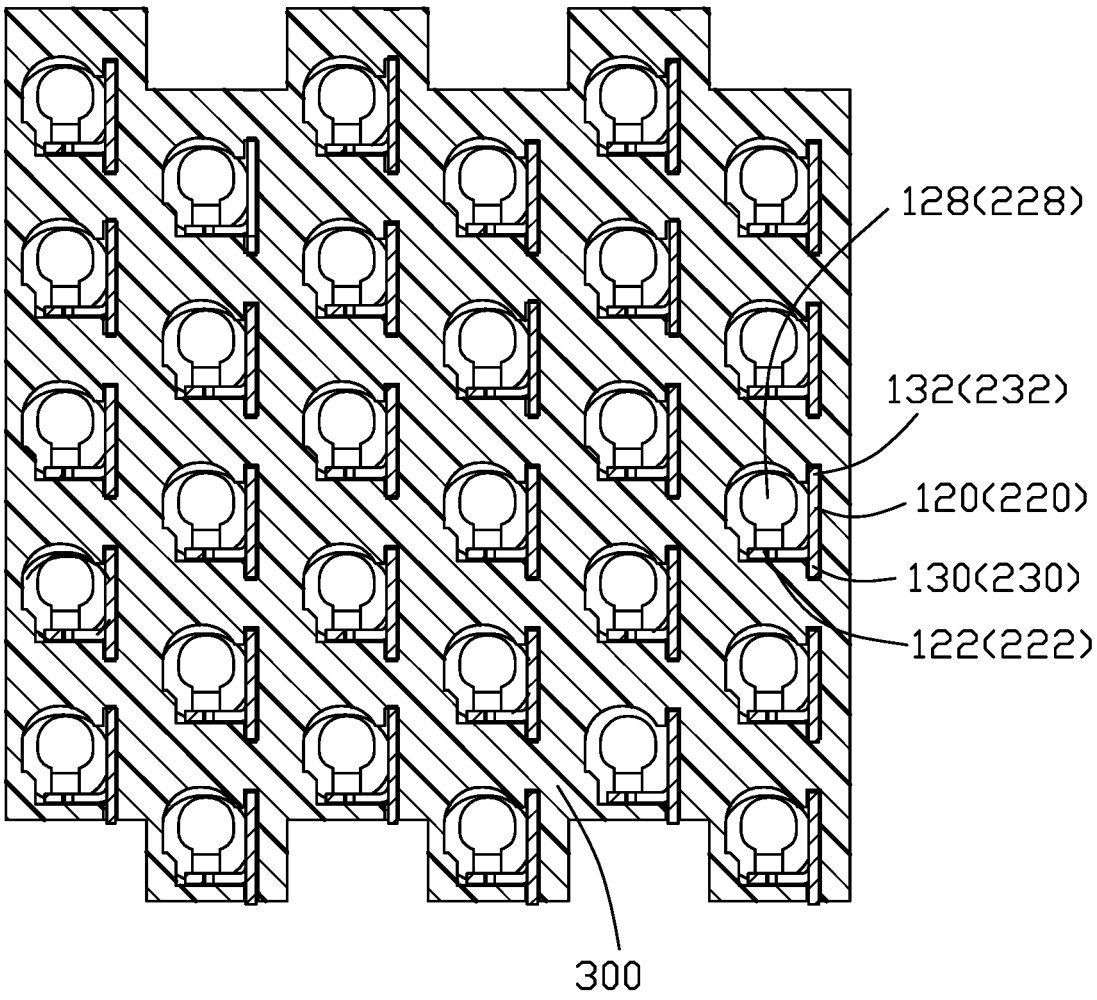
FIG. 7(C) is another cross-sectional view of the electrical connector of FIG. 5(A)
Figure 8A:
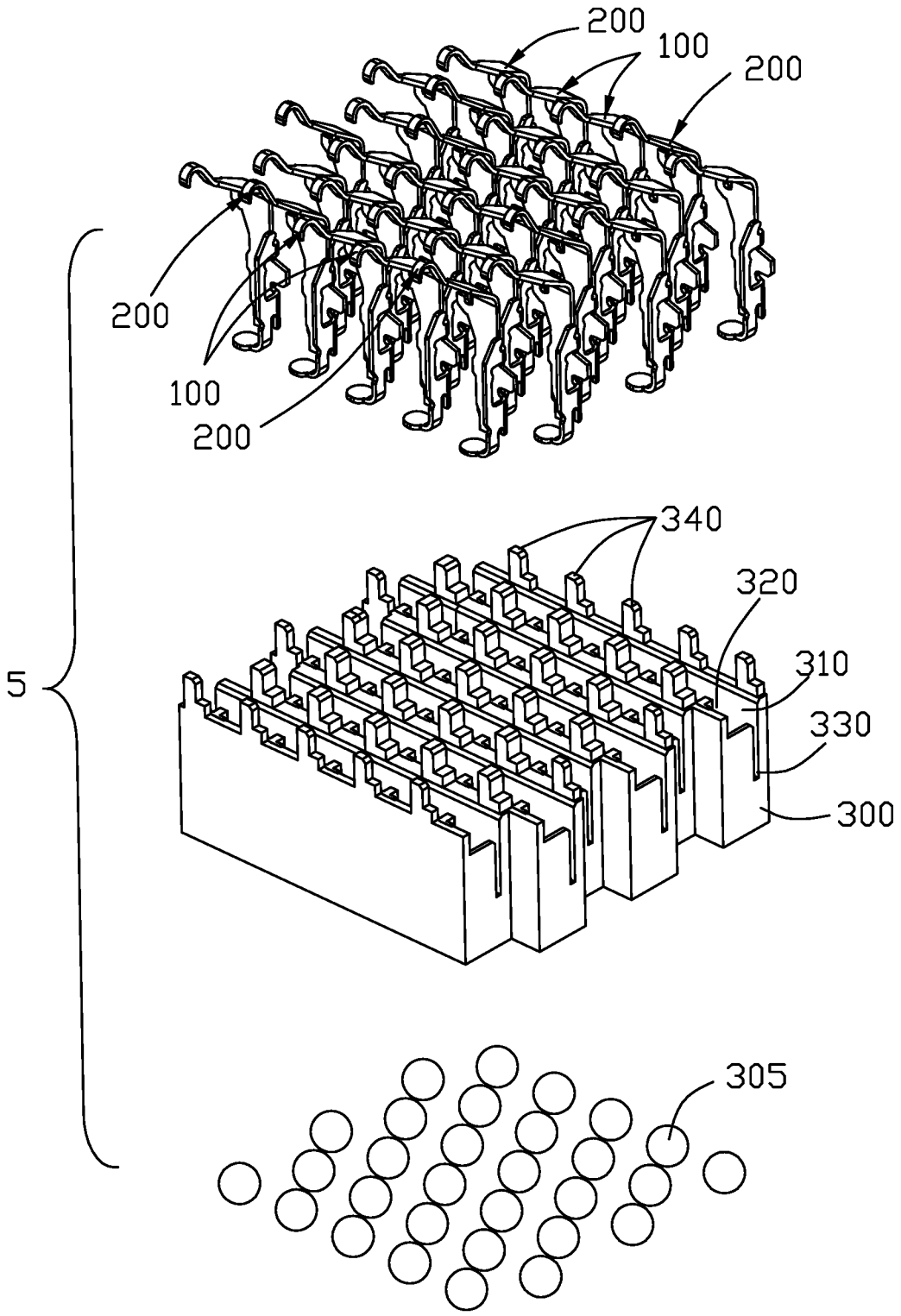
FIG. 8(A) is an exploded perspective view of the electrical connector of FIG. 5(A)
Figure 8B:
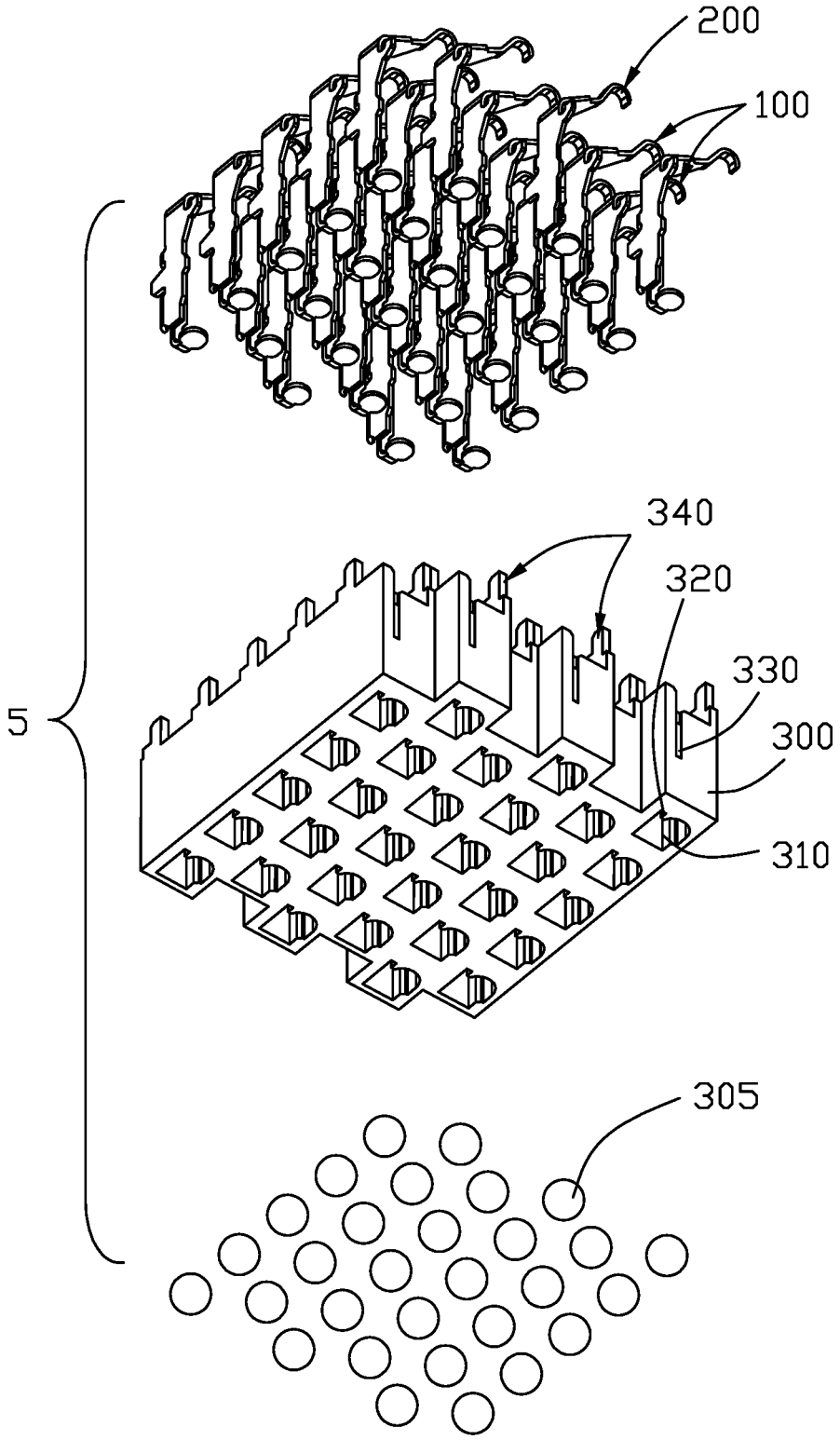
FIG. 8(B) is another exploded perspective view of the electrical connector of FIG. 8(A)
Figure 8C:
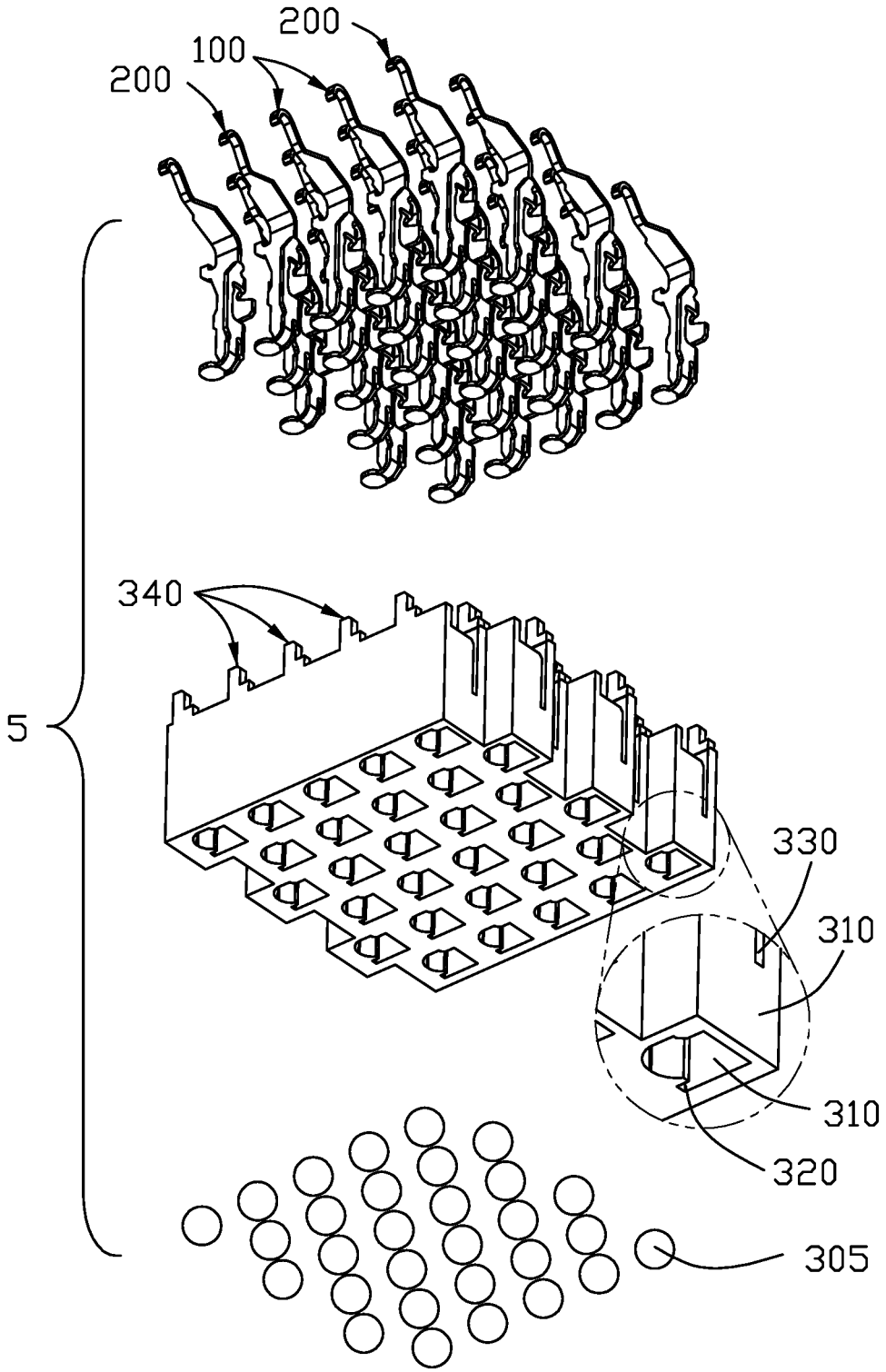
FIG. 8(C) is another exploded perspective view of the electrical connector of FIG. 8(A)
Figure 9:
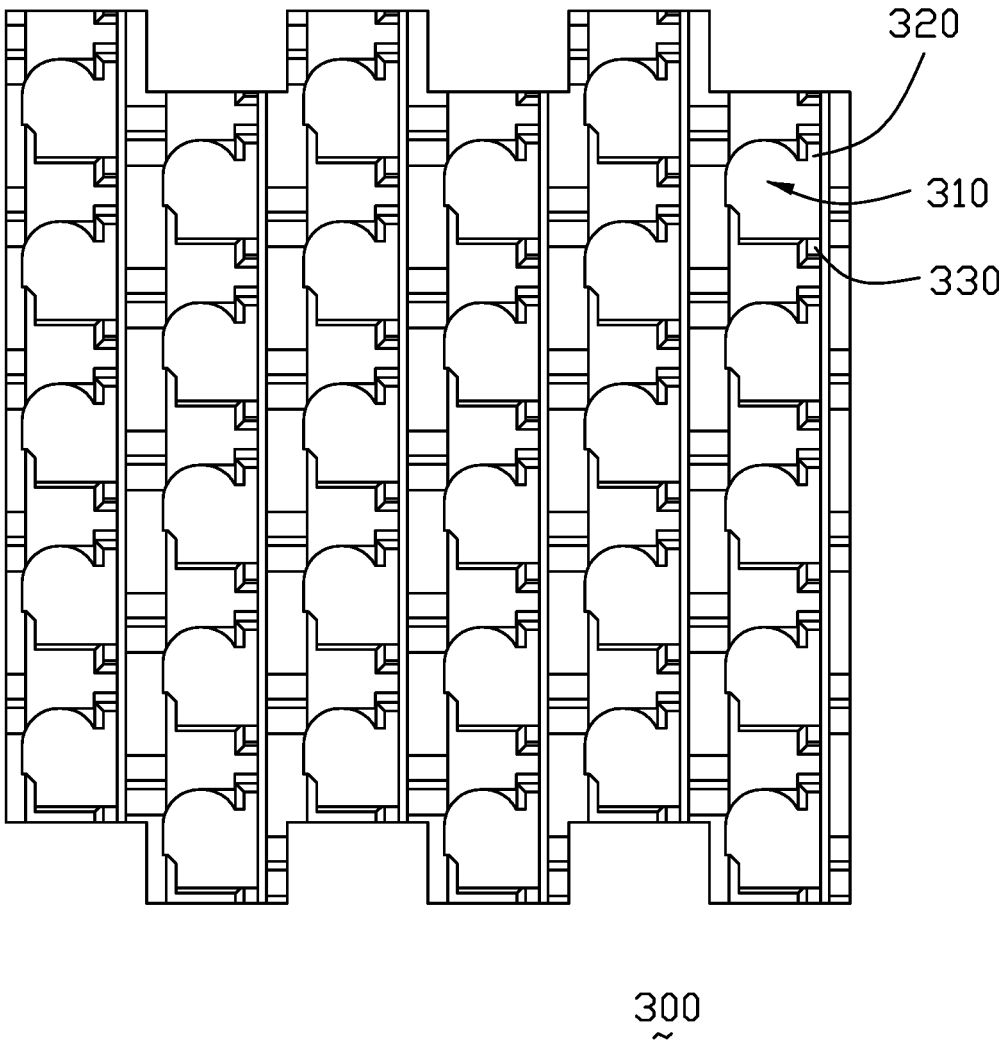
FIG. 9 is a top view of the housing of the electrical connector of FIG. 5(A)
Figure 10A:
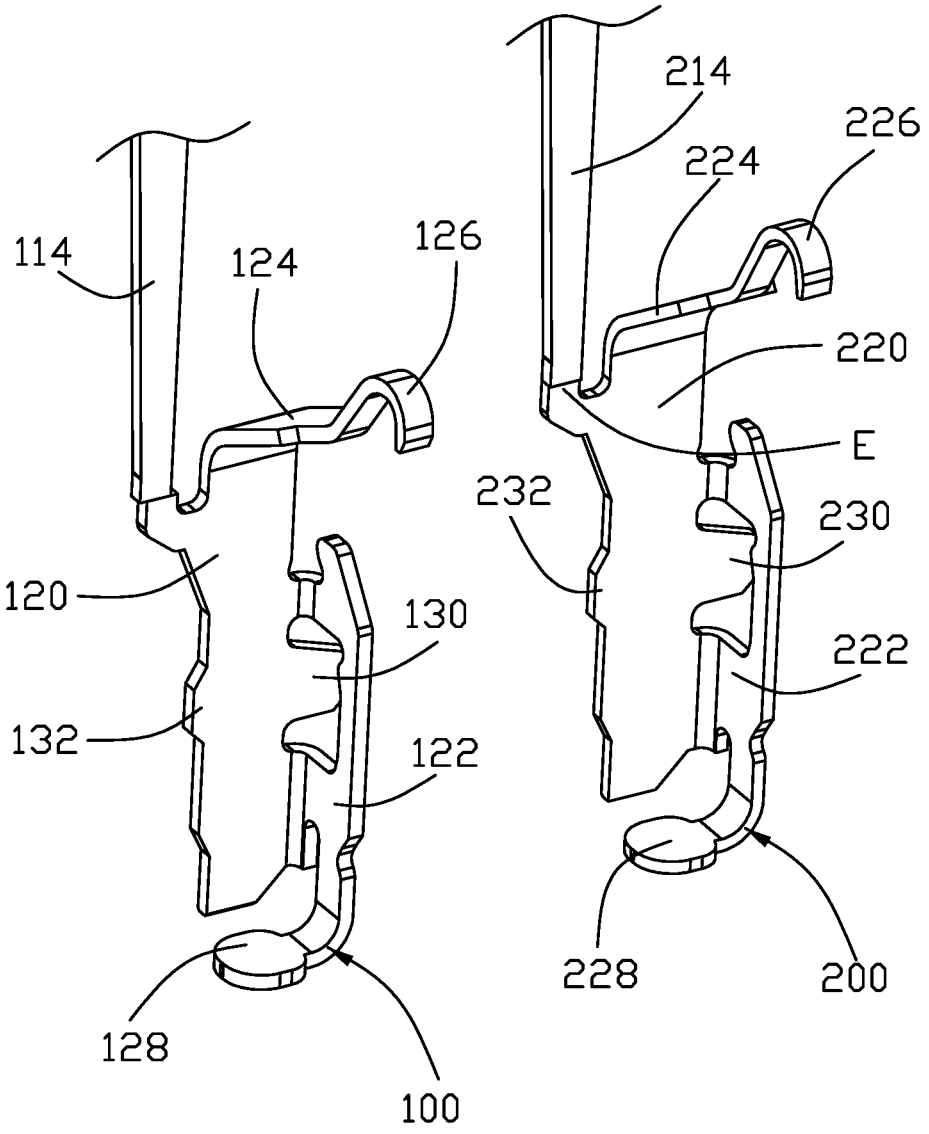
FIG. 10(A) is a perspective view to show a single unit of the contact assembly of FIG. 1(A)
Figure 10B:
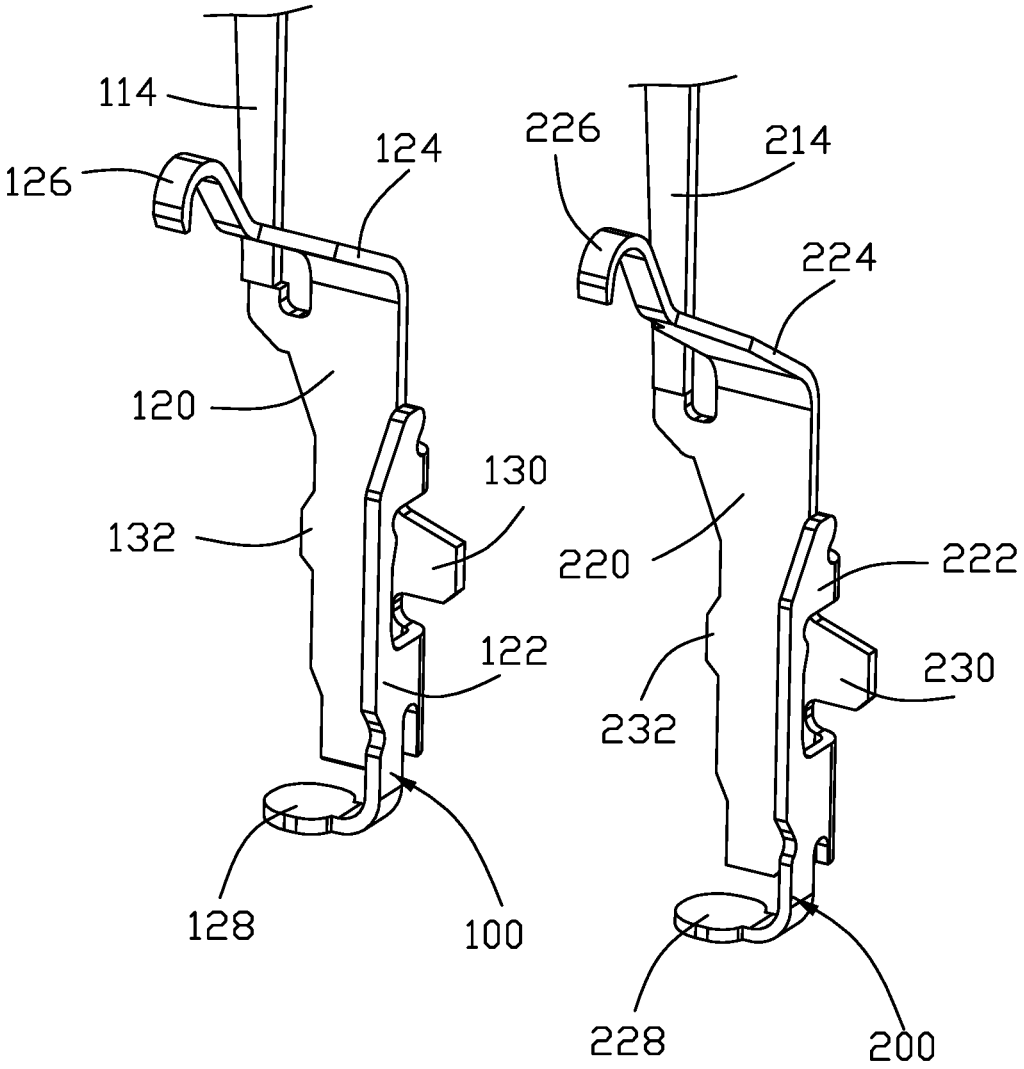
FIG. 10(B) is another perspective view of the signal unit of the contact assembly of FIG. 10(A)
Figure 11:
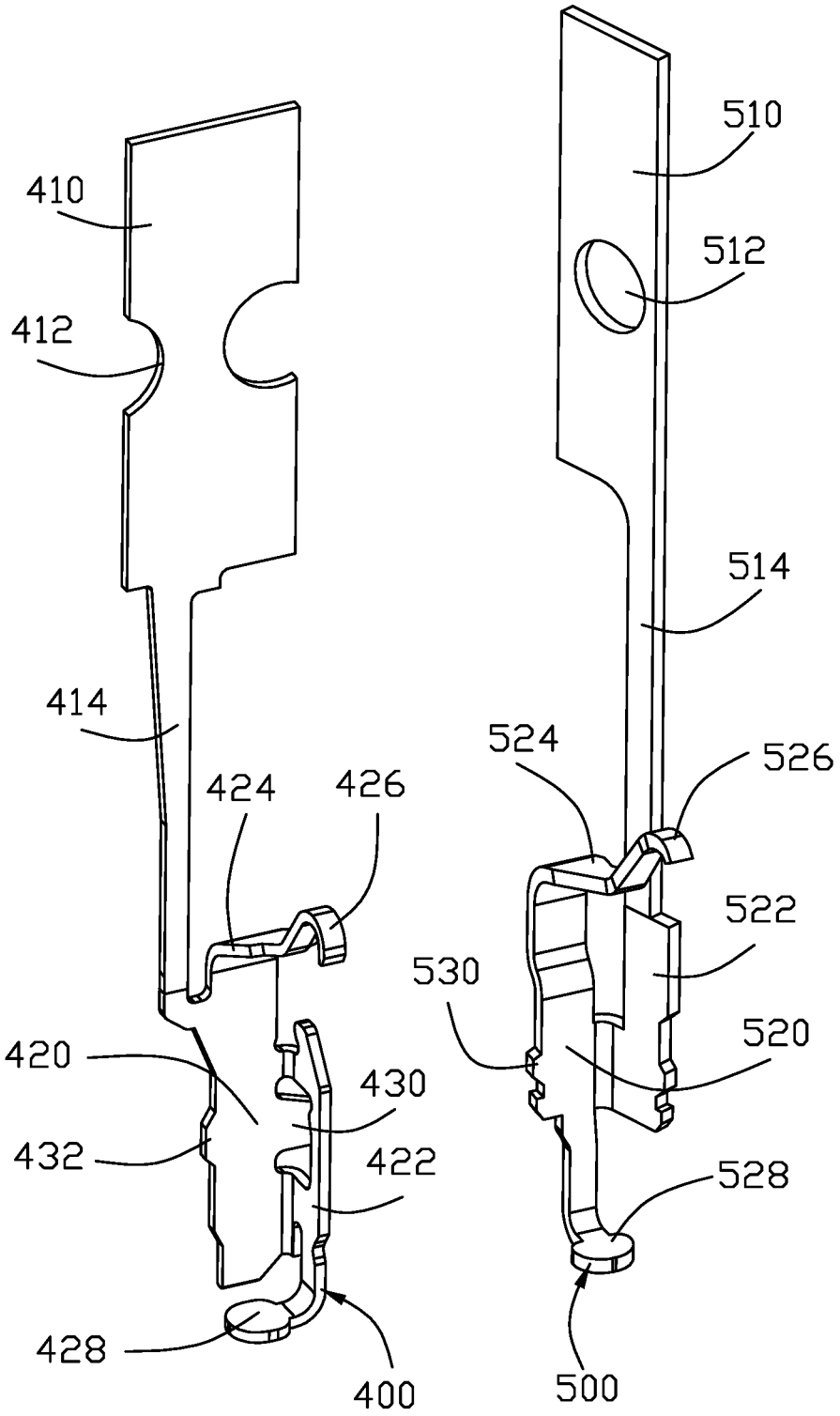
FIG. 11 is a perspective view of the signal unit of the contact assembly according to a second embodiment of the invention.
Figure 12:
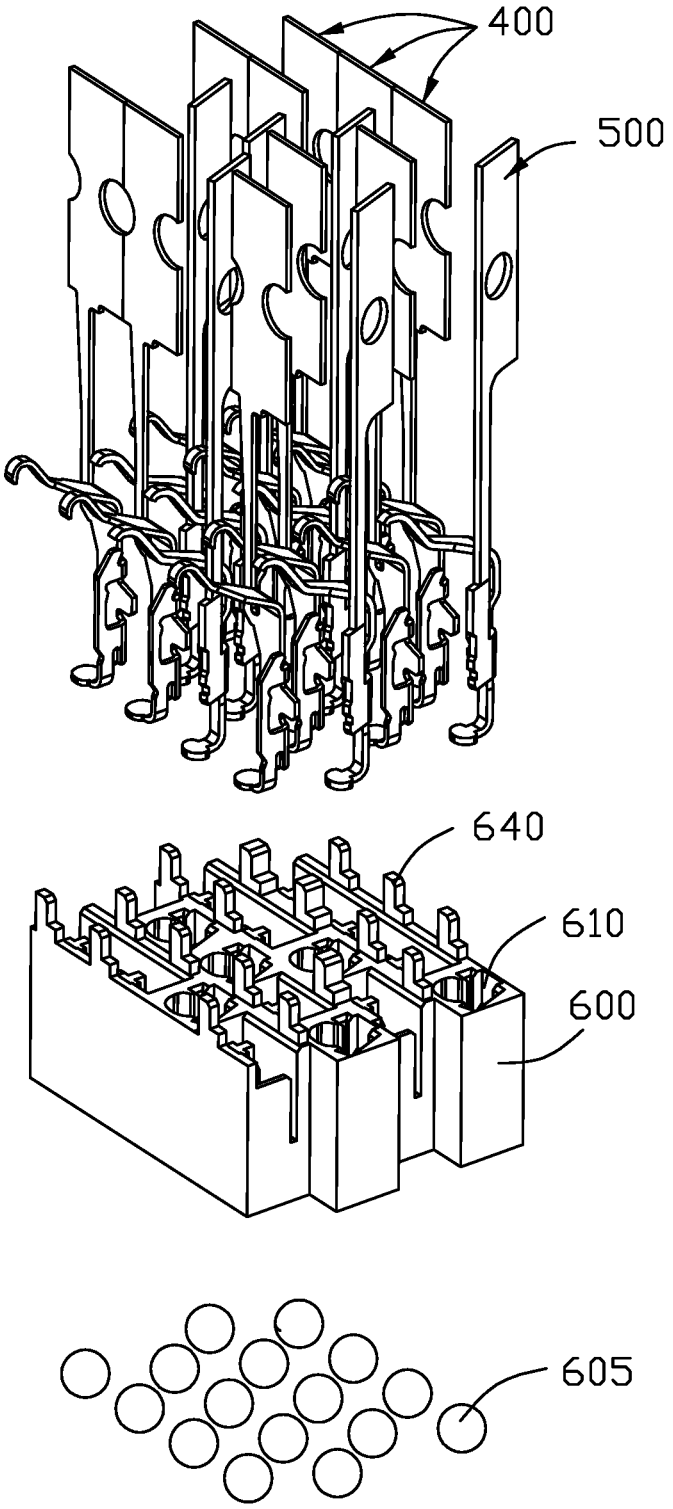
FIG. 12 is an exploded perspective view of the electrical connector assembly equipped with the contact assembly of FIG. 11.
Figure 13:
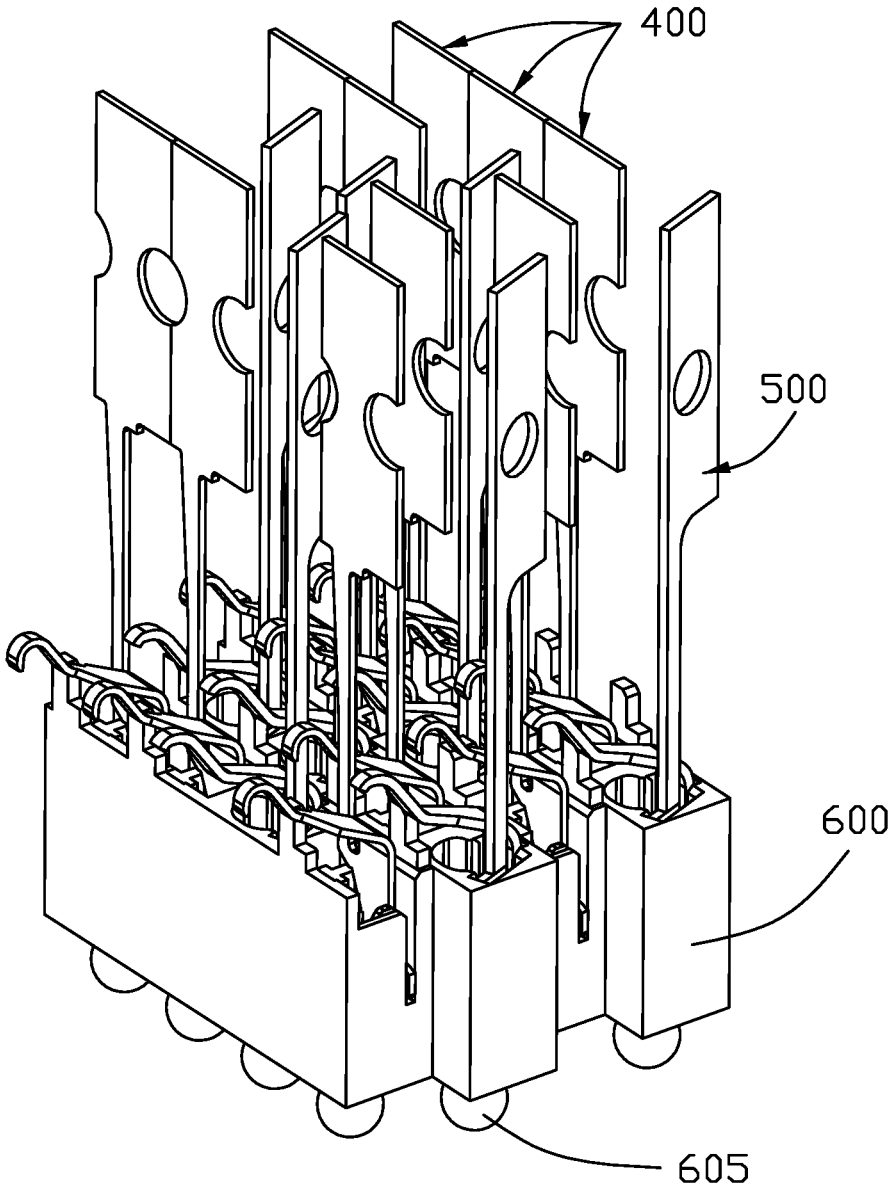
FIG. 13 is an assembled perspective view of the electrical connector assembly of FIG. 12.
Figure 14:
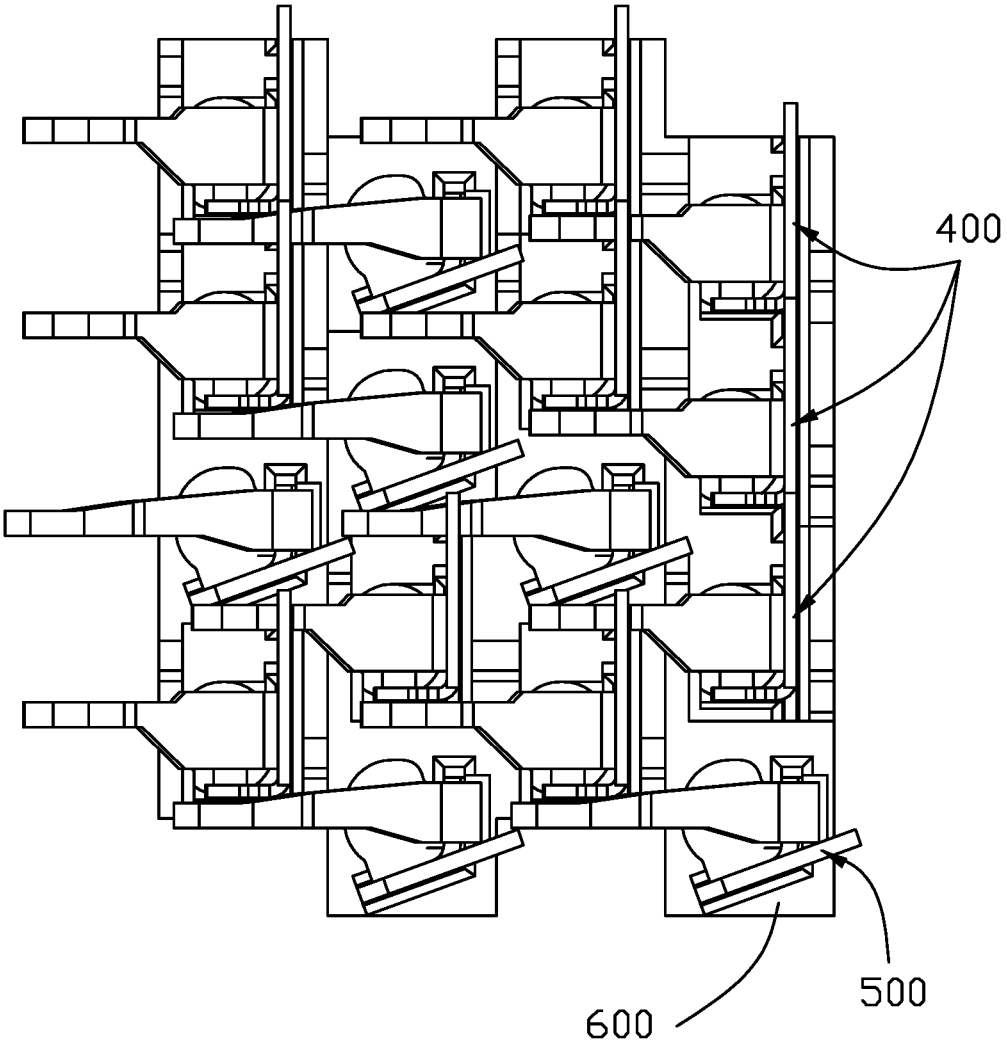
FIG. 14 is a top view of the electrical connector assembly of FIG. 12.

In this embodiment, the second contacting section 226 is higher than the first contacting section 126 when no CPU is loaded upon the housing 300 and the contact is in a relaxed manner. Therefore, when the CPU is mounted upon the connector 5, the second contacting section 226 of the second contact will contact the corresponding conductive pad of the CPU before the first contacting section 126 of the first contact. Anyhow, once the CPU is fully mounted upon the housing 300, both the first contacting section 126 and the second contacting section 226 are located at the same height in a compressed manner. In this embodiment, the second contact is the power contact and the first contact is the signal contact. Notably, in this embodiment, one feature of the invention is for mechanical consideration to have the thickness of the second contact is smaller than that of the first contact so as to achieve the lower normal force than the first contact even if the deflection of the second contact is larger than the first contact. Understandably, the second contact may be thicker than the first contact for electrical consideration while the configuration or the dimension of the second contact may be modified so as to still achieve the smaller normal force than the first contact. In this embodiment, both the first contacts with the corresponding first carrier 110 and the second contacts with the corresponding second carrier 210 are commonly secured to the same fixture 10 to be simultaneously assembled into the corresponding passageways 310 of the housing 300, respectively. As shown in FIG. 10(A), the second main body 220 of the second contact has an upward connecting edge E, which is located adjacent to the second spring arm 224, to connect to the corresponding second extension 214 of the second carrier 210. In addition, as shown in FIG. 7(B), the connecting edge E is essentially flush with a top surface S of the housing 300 for facilitating separation of the second carrier 210 from the second contact. Notably, the first contact has a similar structure as well for the same purpose.

Referring to FIGS. 11-14 showing the second embodiment, the first contact, which is similar to that in the first embodiment, has the first main body 420 with the first retention barbs 432 and 430 on two sides. A first spring arm 424 extends from an upper end of the main body 420 with a first contacting section 426 around a free end. A first auxiliary body 422 extends from a side edge of the first main body 420 with a first soldering pad 428 at the bottom end thereof for securing a solder ball 605 thereto. The first contact is originally linked with the first carrier 410 totally with the reference numeral 400. The first carrier 410 has a first extension 414 linked to the upper end of the first main body 420 and a first holding section 412 for securing to the corresponding fixture (not shown).

The second contact, which is significantly different from the first contact in comparison with the similarity between the first contact and the second contact in the first embodiment, has a second main body 520 with a retention bar 530 on one side. A second spring arm 524 extends from an upper end of the second main body 520 with a second contacting section 526 around a free end thereof. A second auxiliary body 522 extends from a side edge of the second main body 520 with another retention bar (not labeled) on one side. Different from the first embodiment, in the second contact assembly 500 the second soldering pad 528 extends from the bottom end of the second main body 520 for securing the solder ball 605 thereto, and the second carrier 510 with the corresponding holding section 512 therein and the corresponding second extension 514 is linked to an upper end of the second auxiliary body 522.

In the second embodiment, the plural first contact assemblies 400 are commonly secured to the fixture for simultaneously assembling into the corresponding passageways 610 of the housing as what is done in the first embodiment. Anyhow, the second contact assembly 500 is individually assembled into the corresponding passageway 610 in the housing 600. Notably, the direction of the first carrier 410 is different from that of the second carrier 510 in an oblique relation. Understandably, if possible, some of the second contact assemblies 500 may be aligned with one another for common installation into the corresponding passageways of the housing, as performed by the first contact assembly 400 even if the first contact carrier 410 and the second contact carrier 510 have different/angled orientation directions. Notably, the second contact assembly 500 may be assembled into the corresponding passageway 610 after the first contact assembly 400 has been assembled into the corresponding passageway 610 without improper interference.

Notably, in the second embodiment, the passageway 610 receiving the first contact is different from that receiving the second contact. Anyhow, as long as the configurations of the two different type contacts are not significantly different from each other, the passageways for receiving the two different type contacts may be arranged to be of the similar or even the same type so as to perfect the molding consideration. Understandably, in the first embodiment even though the first type contact and the second type contact are slightly different from each other, i.e., the different thicknesses and the different deflections of the spring arms, the corresponding passageways are shared with each other.

Additional, the signal contacts are sensitive to the normal force compared with the power/grounding contacts because the latter are arranged in parallel. Under this situation, using at least two different type contacts in the same socket, using the two type contacts evenly with different regions performing different functions or even in a random arrangement, are different approaches. Anyhow, by using two different type contacts, the signal contacts may be of the relatively expensive type referring to the material or manufacturing cost while the power/grounding contacts may be of the relatively inexpensive type. Understandably, in the existing sockets the signal contacts may be surrounded by the power/grounding contacts for EMI shielding consideration. The different type power/grounding contacts may enhance such shielding effect, if properly arranged.

Figure 15:
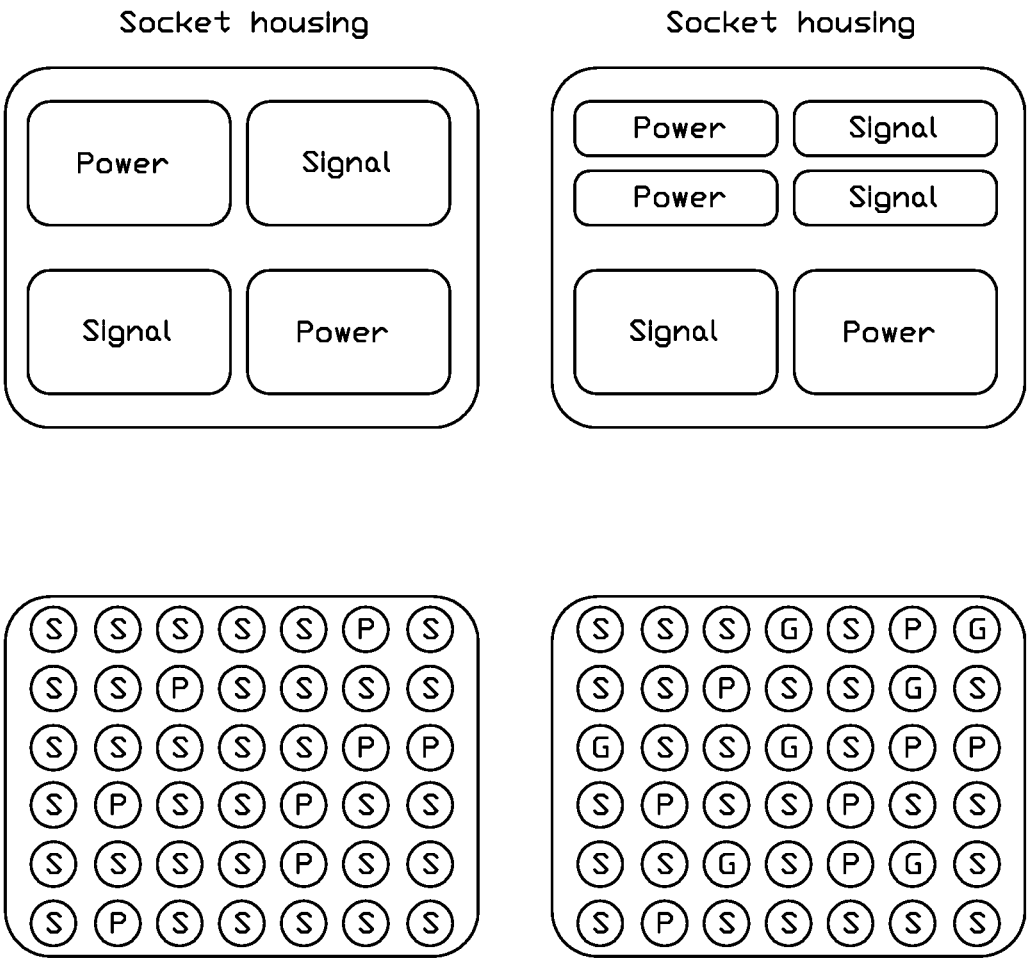
FIG. 15 shows the three different approaches by using two different type contacts.

FIG. 15 shows three ways for the arrangement of the signal contacts and the power contacts with different types in the same socket. The first way refers to the different regions/blocks either with large regions or smaller regions. The second way refers to a random arrangement. The third way refers to more than two type contacts, i.e., at least three.

Figure 16:
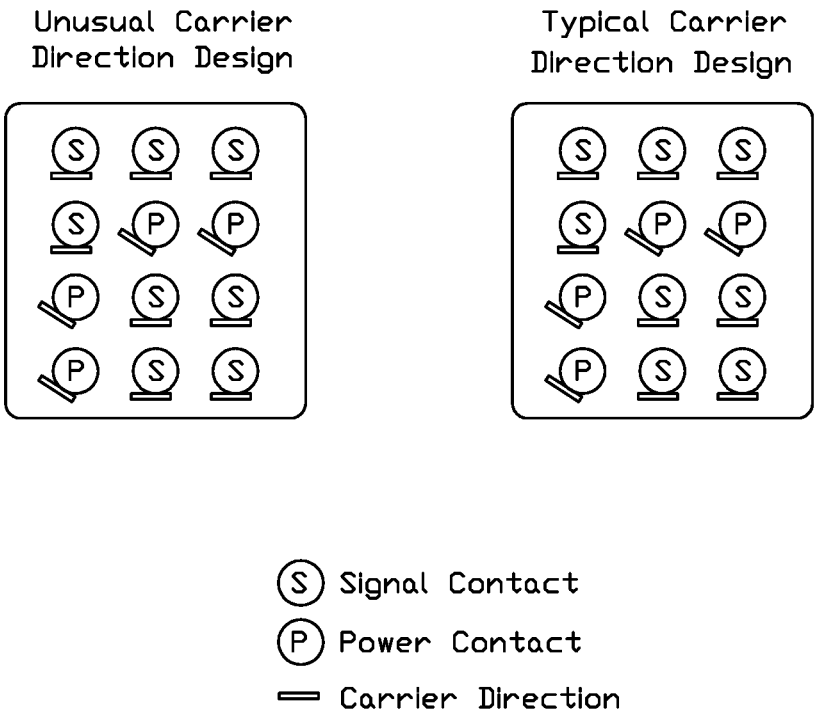
FIG. 16 illustrates the second embodiment.

FIG. 16 shows illustration of the second embodiment wherein the carriers of the power contacts extend in an oblique direction while the those of the signal contacts extend in the transverse direction and could be aligned together for one step installation.

Figure 17:
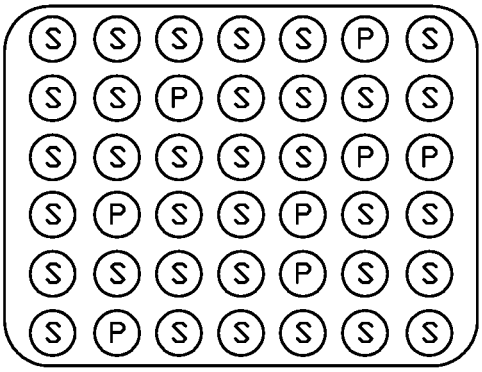
FIG. 17 illustrates the first embodiment and a third embodiment.

FIG. 17 shows illustration of the first embodiment wherein both the first type contacts and the second type contacts are installed into the corresponding passageways via a same fixture at one time, and that of a third embodiment wherein the first type contacts associated with the corresponding carriers are assembled into the corresponding passageways in the first vertical direction while the second type contacts associated with the corresponding carriers are assembled into the corresponding passageways in the second vertical direction opposite to the first vertical direction. Notably, the carriers of the first type contacts may be unified together and the carriers of the second type contacts may be unified together.

Figure 18:
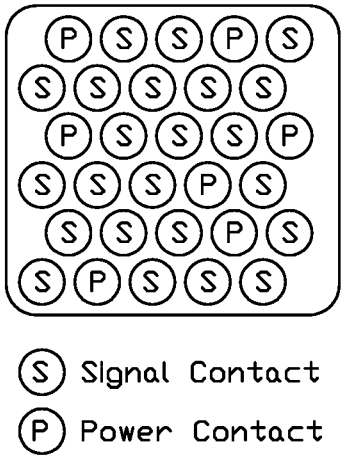
FIG. 18 illustrates the corresponding structures of the first embodiment.

FIG. 18 shows illustration of the first embodiment wherein the socket has two different type contacts with different deflections of the spring arms while aligned at the same height after loading of the CPU. The power contact has the smaller normal force than the signal contact even if under the larger deflection of the spring arm. The material and the thickness of the first type contact are different from those of the second type contact. The same passageways receive different type contacts. In this embodiment, the wiping action/distance of the power contact is larger than that of the signal contact because of the larger deflection thereof. Anyhow, the same wiping distance may be achieved if the dimension or configuration of the spring arm is specifically arranged. Understandably, the wiping distance may extend along a diagonal direction of the corresponding conductive pad of the CPU, if possible, as long as such a wiping action is always applied on the corresponding conductive pad. In this embodiment, the signal contact has the smaller yield stress than the power contact while having the larger elastic modulus than the power contact.

Figure 19:
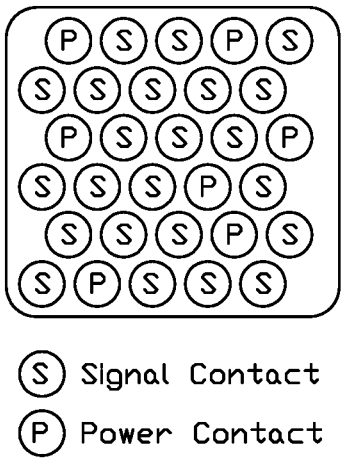
FIG. 19 illustrates the assembling method of the first embodiment.

FIG. 19 shows illustration of the first embodiment wherein the different type contacts associated with the carriers are commonly secured to the same fixture for installation into the corresponding passageways simultaneously.

Figure 20:
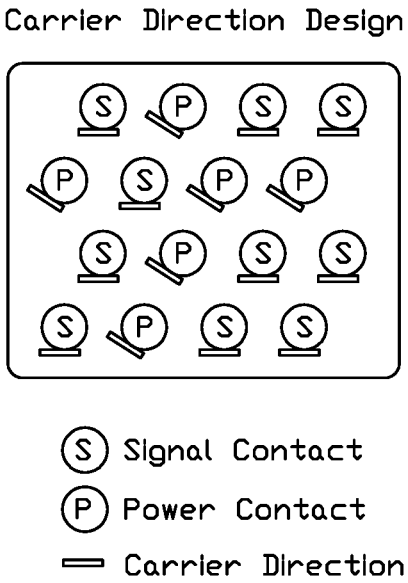
FIG. 20 illustrates the second embodiment.
Figure 21:
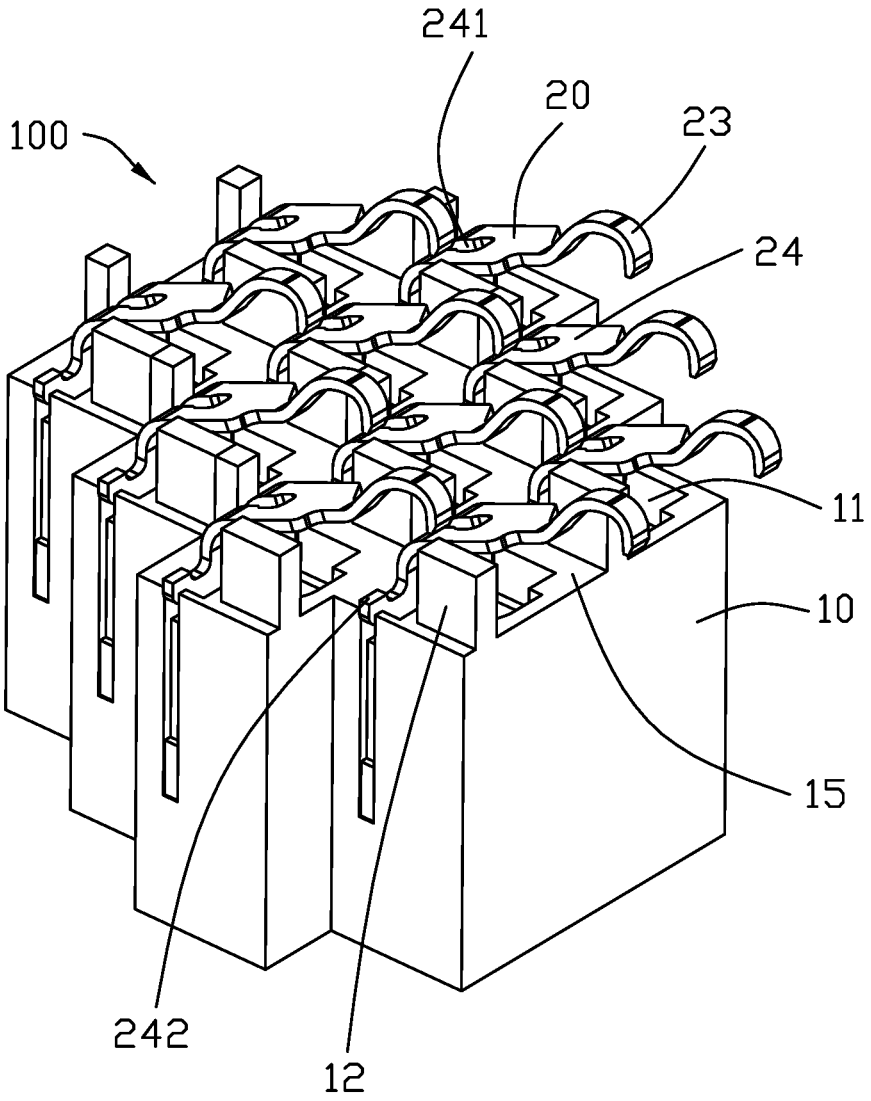
FIG. 21 is a perspective view of an electrical connector according to a fourth embodiment of the invention.
Figure 22:
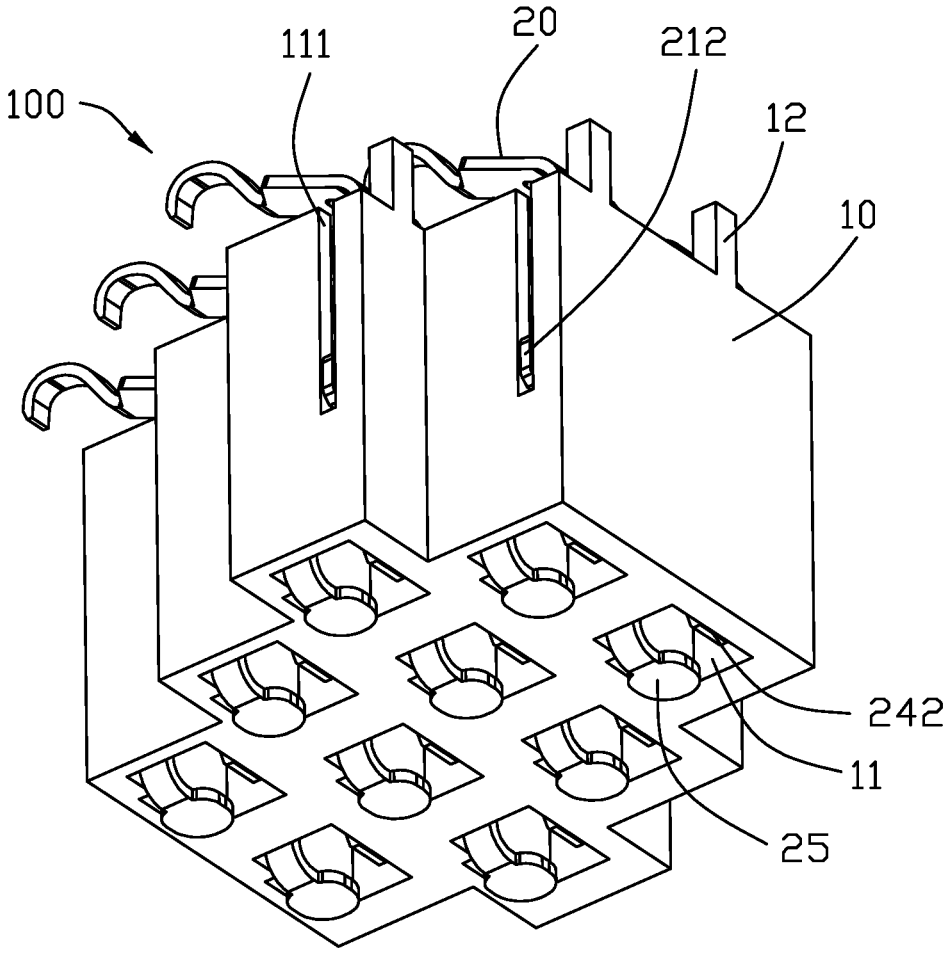
FIG. 22 is another perspective view of the electrical connector of FIG. 21.
Figure 23:
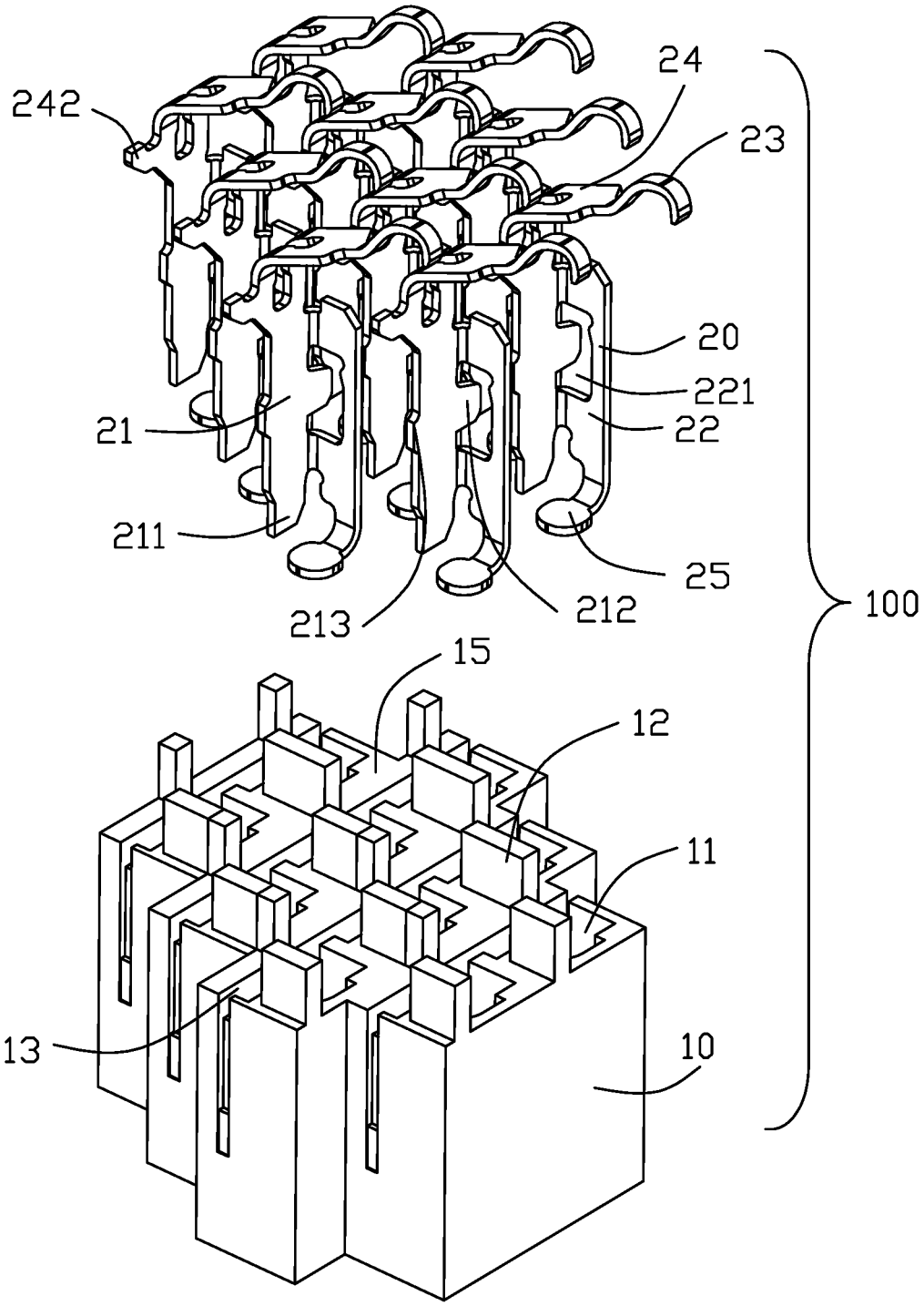
FIG. 23 is an exploded perspective view of the electrical connector of FIG. 21.
Figure 24:
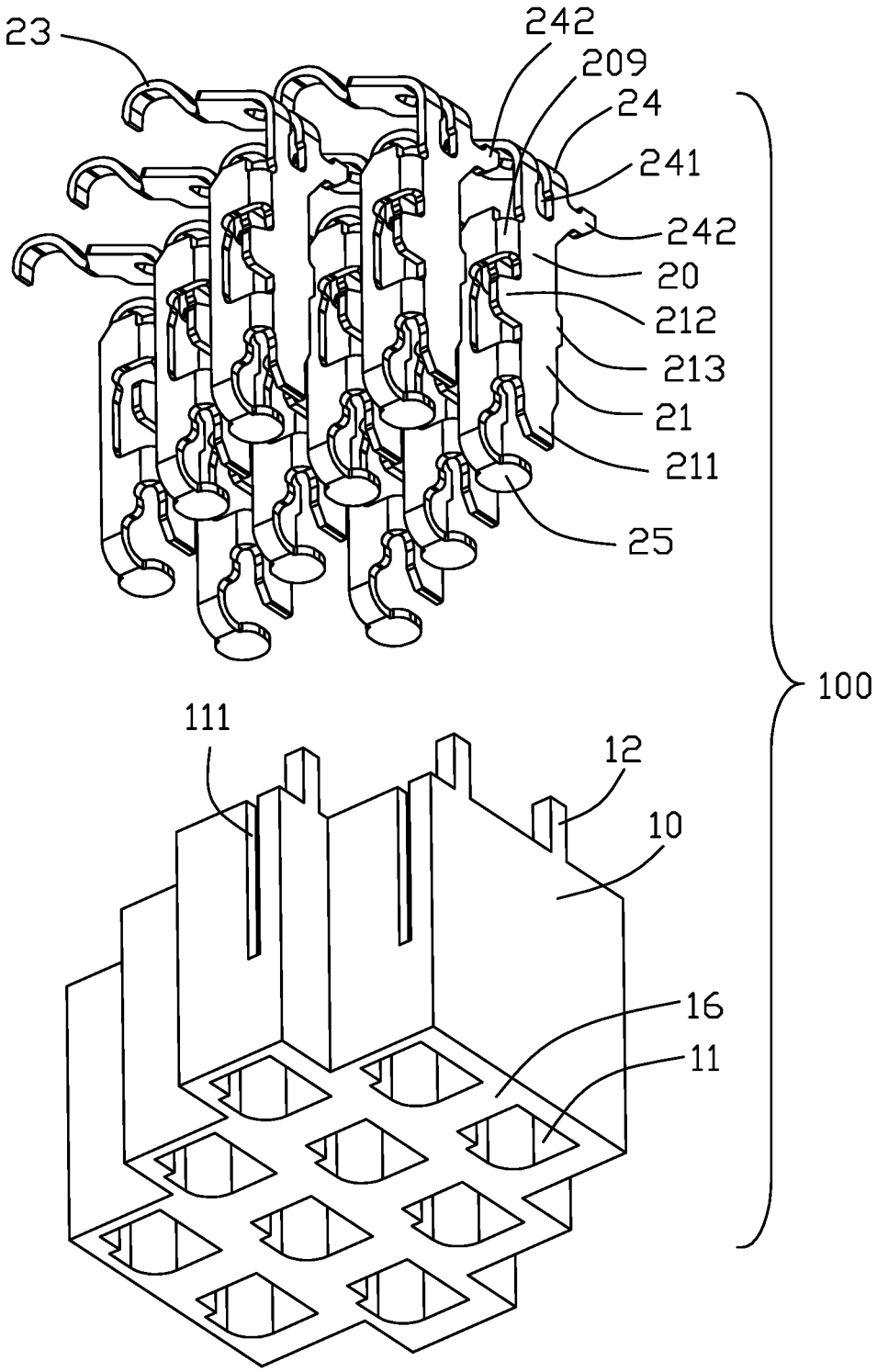
FIG. 24 is another exploded perspective view of the electrical connector of FIG. 23.
Figure 25:
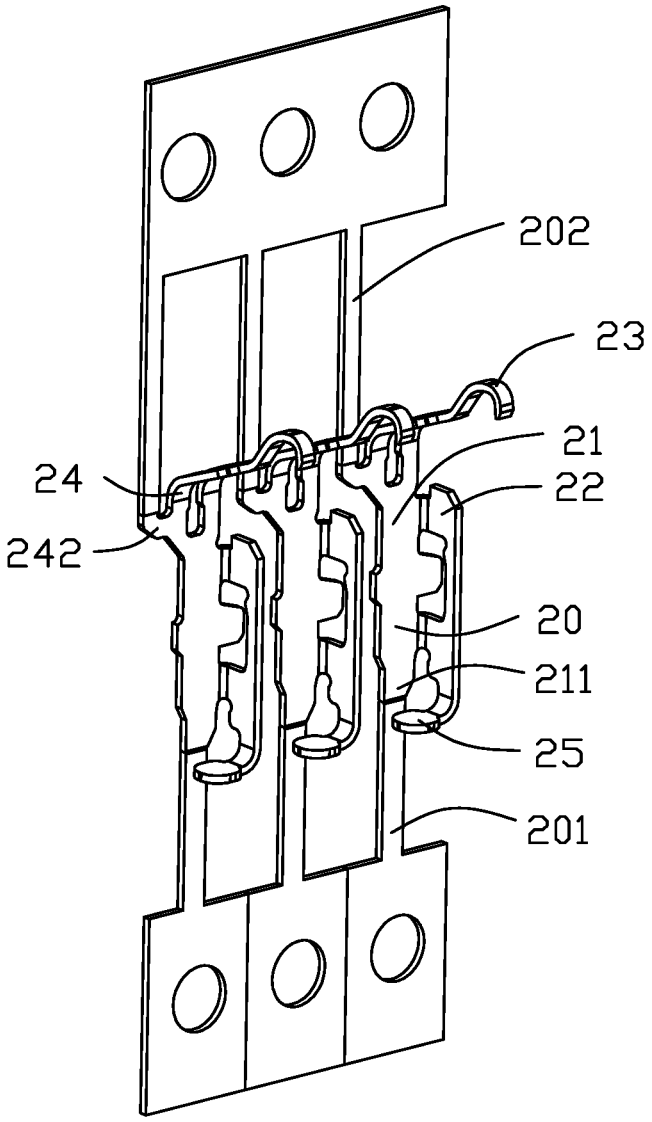
FIG. 25 is a perspective view of the contacts in the same row of the electrical connector of FIG. 21 wherein both the upper carrier and the lower carrier are not removed from the corresponding contacts.
Figure 26:
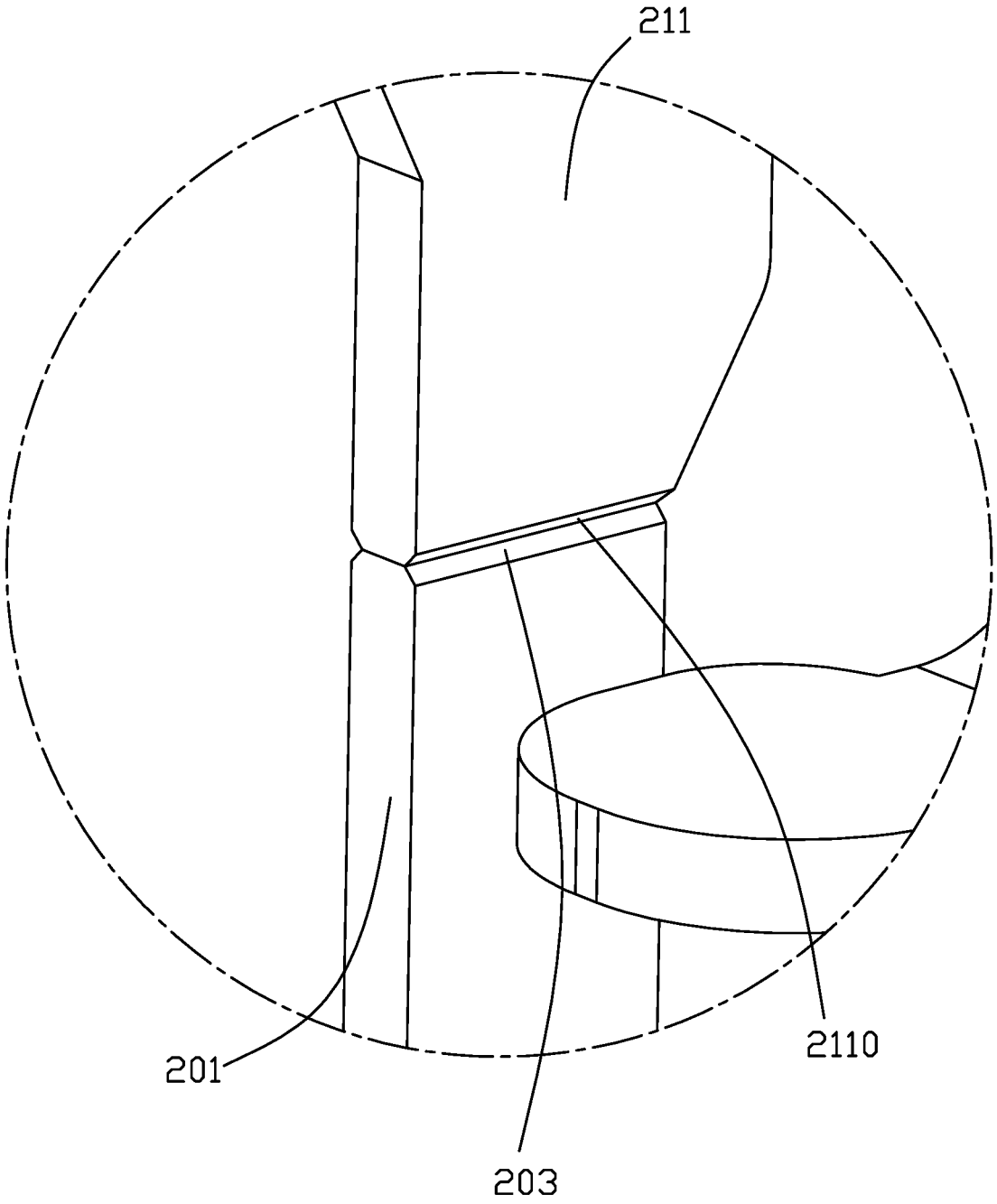
FIG. 26 is an enlarged perspective view of a portion of the contact of the electrical connector of FIG. 25.
Figure 27:
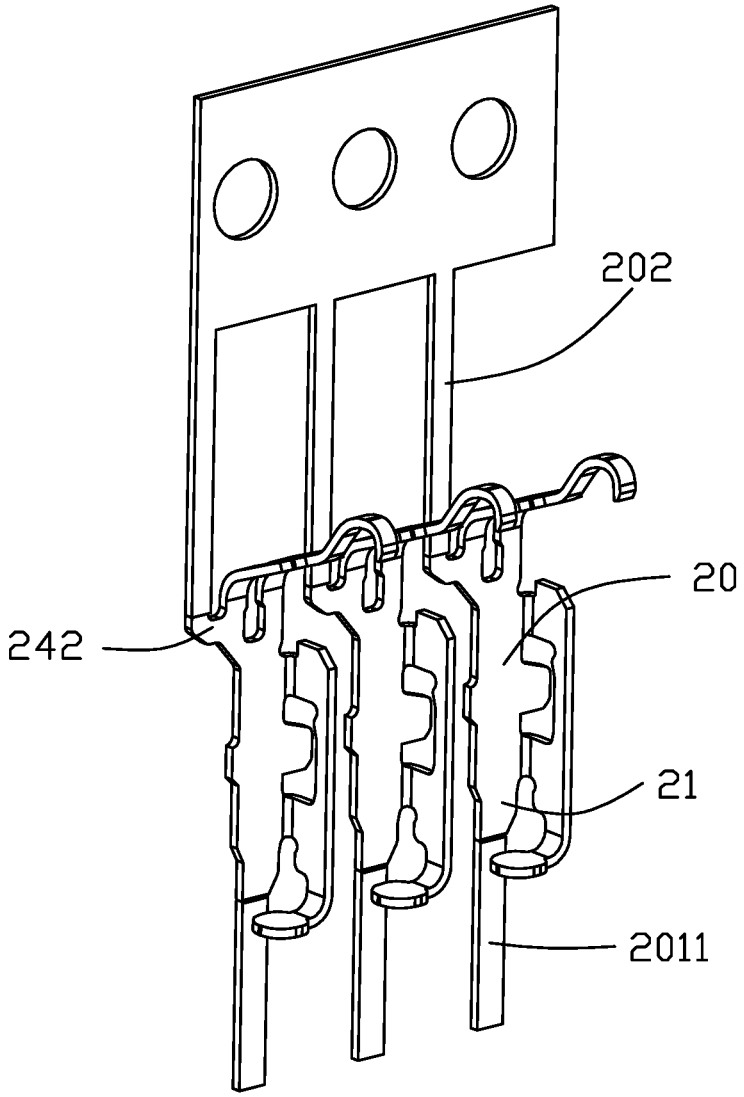
FIG. 27 is a perspective view of the contacts of the electrical connector of FIG. 25 wherein the cross bar of the lower carrier is removed from the linking legs of the lower carrier.
Figure 28:
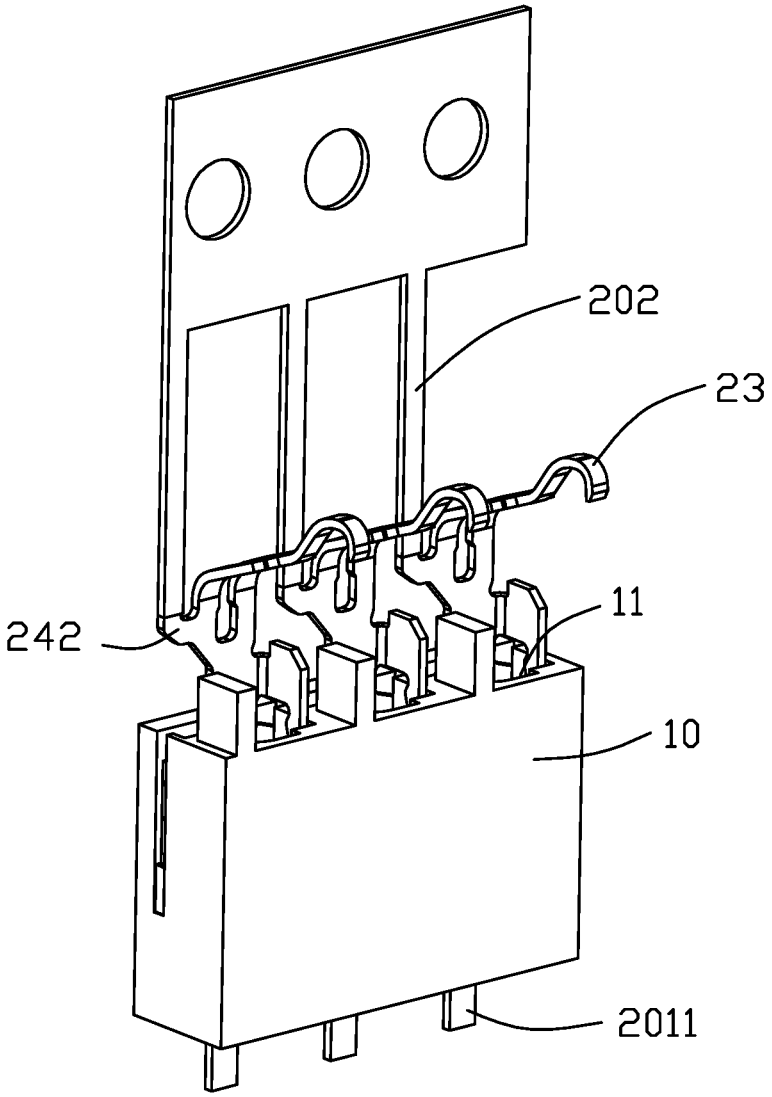
FIG. 28 is a perspective view of a portion of the electrical connector of FIG. 21 wherein the contacts are assembled into the corresponding passageways in the initial upper positions.
Figure 29:
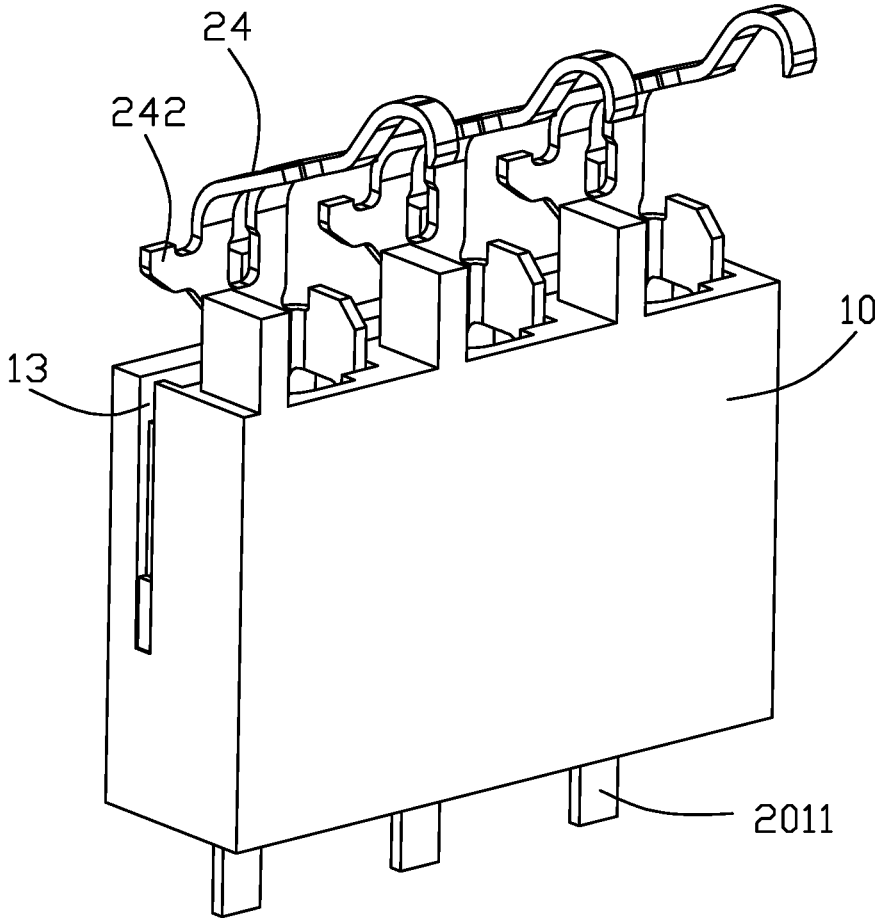
FIG. 29 is a perspective view of the portion of the electrical connector of FIG. 28 wherein the upper carrier is removed from the contacts.
Figure 30:
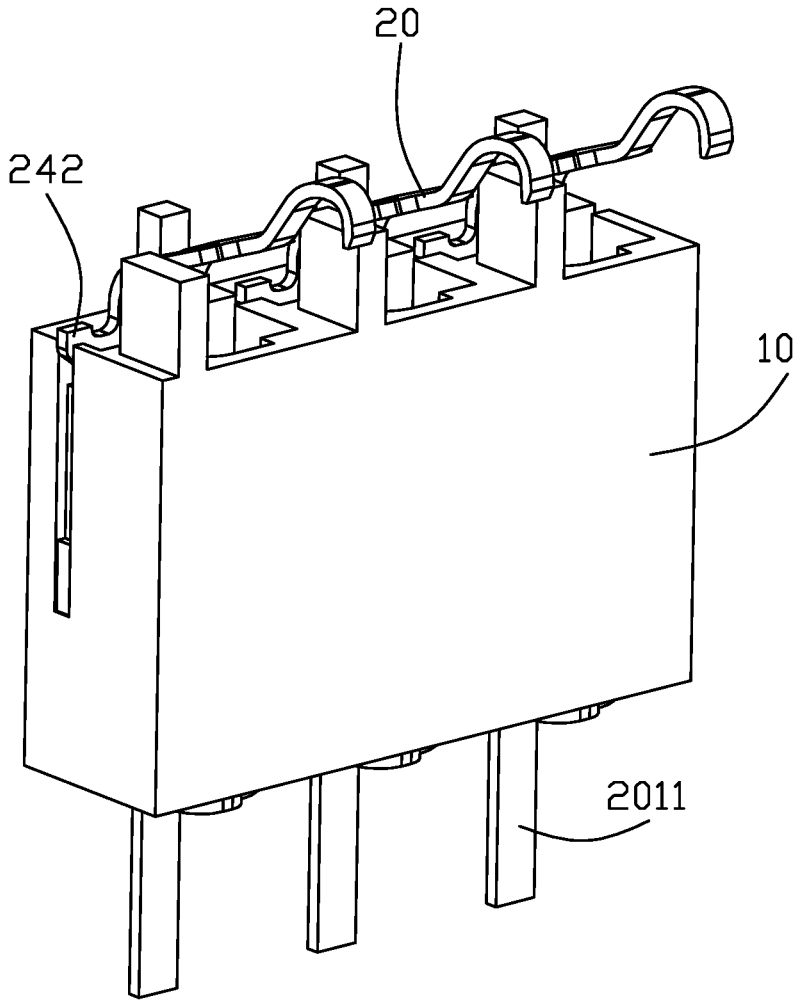
FIG. 30 is a perspective view of the portion of the electrical connector of the FIG. 29 wherein the contacts are moved to the final lower positions and FIG. 31 is a perspective view of the portion of the electrical connector of the FIG. 29 wherein the linking legs of the lower carrier are removed from the contacts.
Figure 31:
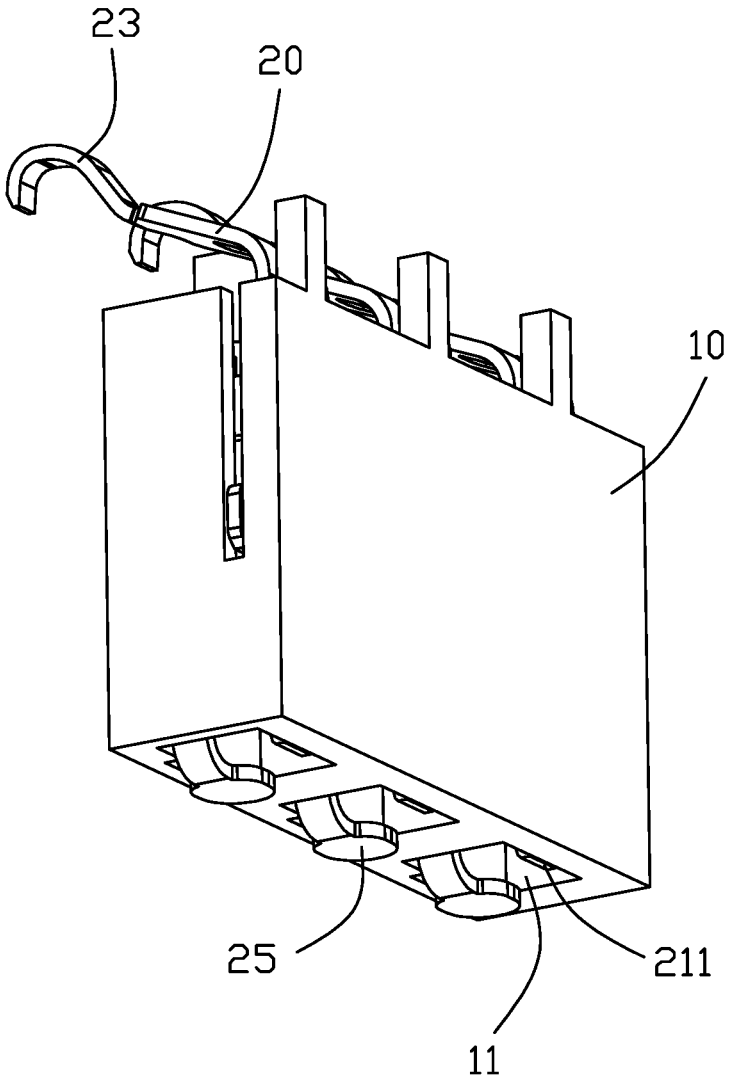

FIG. 20 shows illustration of the second embodiment wherein the first type contacts associated with the first type carriers and the second type contacts associated with the second carriers could commonly exist on the housing without interference so as to allow installation of both type contacts before removal of the corresponding carriers. In other words, the firstly installed contacts and the corresponding carriers should not block the secondly installed contacts and the corresponding carriers. In this embodiment, the power contacts are firstly installed and the signal contacts are successively installed.

In brief, even though in the disclosed embodiments the power contact has less normal force than the signal contact, the opposite mutual relation may be another choice as long as two different normal forces exist on two different type contacts respectively that may facilitate perfection of the high frequency transmission with different arrangement approaches or other considerations. Another feature of the invention is to provide a plurality of contacts 100, 200 each originally having an unitary/integral holding part 110 which is assembled to the assembling part 10 and inserted into the corresponding passageway 310 of the housing 300 with other contacts 100, 200 wherein the holding part 110 can be removed/severed from the contacts 100, 200 after the contacts 100, 200 are assembled within the corresponding passageways 310 of the housing 300. Notably, the traditional contacts are essentially unitarily formed on the corresponding carrier and simultaneously inserted into the corresponding passageways of the housing by the carrier, and successively removed from the carrier after the contacts are completely assembled within the passageways of the housing. Understandably, in the traditional contact design, because the contact is required to be unitarily formed with the carrier for common insertion, there is some limitation to provide the properly configured contacting section or retaining section on the contact for meeting high frequency transmission. The instant invention uses the assembling part 10 and the holding part 110 to replace the traditional one-piece carrier for assembling a plurality of contacts into the corresponding passageways 310 of the housing 300, thus allowing more complexity of the configuration of the contact during forming the contact via sheet metal wherein such complex configuration of the contact may achieve the high frequency transmission advantageously.

The feature of the invention disclosed in the first embodiment and the second embodiment is to provide a method of assembling the contacts into the housing by using a fixture 10 retaining the carriers 110/210 of the respective contacts 110/210 to initially commonly move the corresponding contacts 100/200 downwardly toward the housing 300 and into the corresponding passageways 310 of the housing until reach their final positions, and successively to remove the respective carriers 110/210 from the corresponding contacts 100/200. The steps of making the electrical connector comprises (i) providing an insulative housing 300 with a plurality of passageway 310; (ii) providing a plurality of contacts 100/200 unitarily with the corresponding carriers 110/210, respectively, wherein the contacts 100/200 associated with the unitary carriers 110/210 are discrete from one another; (iii) providing a fixture 10 to have the carriers 110/210 of the contacts 100/200 commonly retained to the fixture in one row; (iv) downwardly moving the fixture 10 to have the contacts 100/200 inserted into the corresponding passageways 310 simultaneously and reaching their final positions in the vertical direction; and (v) detaching the respective carriers 110/210 from the corresponding contacts 100/200 simultaneously.

Referring to FIGS. 21-31 related to another embodiment, an electrical connector 100 for connecting an electronic package, i.e., a CPU (Central Processing Unit), and a PCB (printed circuit board), includes an insulative housing 10 and a plurality of contacts 20 therein.

The housing 10, which is not completely shown for easy illustration of the internal structures, forms opposite top surface 15 and bottom surface 16 and a plurality of passageways 11 extending through both the top surface 15 and the bottom surface 16 in the vertical direction for receiving the contacts 20 therein. A plurality of standoffs 12 are formed on the top surface 15 corresponding to one side of the corresponding passageways 11, respectively. Each passageway 11 further communicates with a firs side groove 13 adjacent to the corresponding standoff 12, and a second side groove 111 opposite to the first side groove 13.

The contacts 20 are arranged in matrix. Each contact 20 includes a main body 21 and a secondary body 22 sidewardly connected and angled with the main body 21 in a top view, a spring section 24 connected to an upper portion of the main body 21, a resilient contacting section 23 extending upwardly and obliquely from the spring section 24, and a soldering/tail section 25 downwardly extending from a lower portion of the secondary body 22 with a solder ball thereon for soldering to the printed circuit board. Both the main body 21 and the secondary body 22 are received within the corresponding passageway 11. Both the spring section 24 and the contacting section 23 extend above the top surface 15.

The spring section 24 forms a narrow slot 241, and is wider than the contacting section 23. The width of the main body 21 is larger than that of the contacting section 23 while being smaller than that of the spring section 24. The narrow slot 241 of the spring section 24 is located proximate the stress concentration area so as to lower the impedance by adjusting the dimension and the position of the narrow slot. A first retention tab 212 is formed on one lateral side edge of the main body 21 and located within an opening 221 formed by the secondary body 22, and a second retention tab 213 is formed on the other lateral side edge of the main body 21 opposite to the first retention tab 212 in a transverse direction. Both the first retention tab 212 and the second retention tab 213 are coplanar with the main body 21 for stabilization of the contact 20. After assembled, the first retention tab 212 is received within the second side groove 111.

Each row of contacts 20 are originally/initially linked together with a lower/first carrier 201 linking to a lower/first linking part 211 located on a bottom portion of the main body 21, and an upper/second carrier 202 linking to an upper/second linking part 242 located on a top portion of the main body 21 beside the spring section 24. A V-shape recess 203 is formed in the border between the lower carrier 201 and the lower linking part 222 for easy breaking thereabouts so as to form a tapered end 2110 of the first linking part 211. In this embodiment, the spring section 24 is located above a linking edge bordered between the upper linking part 242 and the upper carrier 202. The spring section 24 forms therein a slot (not labeled) aligned with the contacting section 23 along the extension direction.

When the contact 20 is fully assembled within the corresponding passageways 11, the upper linking part 242 is received within the corresponding first side groove 13 securely. Understandably, the retention between the upper linking part 242 and the housing 10 may not only enhance the stability of the contact 20 in the passageway 11 but also allow easy separation between the upper linking part 242 and the upper carrier 202 if such a separation occurs after the contact 20 is completely assembled within the passageway 11.

The method of making the connector 100 is as follows: (i) providing an insulative housing 10; (ii) removing the transversely extending crossbar of the lower carrier 201 with the respective remaining posts 2011 which are respectively linked with the lower linking parts 211 of the contacts 20; (iii) downwardly assembling/pushing the contacts 20 into the corresponding passageways 11 via applying a downwardly force upon the upper carrier 202 until the contacts 20 reach the predetermined upper position wherein the upper linking part 242 of each contact 20 is located above the top surface 15, and the remaining posts 2011 are not completely exposed below the bottom surface 16 but corresponding upper portions of those remaining posts 2011 are still located within the corresponding passageway 11; (iv) removing the upper carrier 202 from the upper linking parts 242 of the corresponding contacts 20; (v) holding the respective remaining posts 2011 by a tool to pull the contacts 20 downwardly to reach the final/lower position in the corresponding passageways 11 wherein the upper linking part 242 is snugly received within the corresponding first side groove 13 securely, and the respective remaining posts 2011 are essentially fully exposed under the bottom surface 16 for easy breaking; and removing the respective remaining posts 2011 from the corresponding lower linking parts 211 to finalize assembling of the whole connector 100.

As mentioned before, the traditional contacts are basically linked to only one carrier with one step insertion/pushing for assembling the contact into the corresponding passageway. The drawback of such a traditional design is the difficulties for removing the carrier from the linking parts of the contacts without damaging or interfering with the neighboring contacting sections of the contacts due to the limited space thereabouts in a fine pitch arrangement. Differently the instant invention uses two opposite carriers respectively linked/operated at opposite upper/lower sides of the contact, thus providing the sufficient space above the top surface of the housing for easy removal of the upper carrier from the upper linking parts of the contacts. The upper carrier and the lower carrier respectively linked to the opposite upper linking part and lower linking part of the contact, is the main feature of the invention. In addition, the invention using two steps assembling, i.e., the initial/upper position and the final/lower position of the contact, is another feature of the invention wherein the upper carrier is removed when the contacts are located at the upper positions with regard to the housing. Because of the remaining posts which does not exist in the traditional design, the contacts can be moved from the upper/initial position to the lower/final position by another tool applied on such remaining posts, and then those respective remaining posts can be easily removed from the corresponding lower linking part around the bottom surface of the housing because no significantly extending part of the contact is located beside the lower linking part to be damaged due to the bending operation of removing the remaining posts. In brief, through the two carriers' structure, variability of the contact design is increased, and further through the two steps assembling method, manufacturability of the fine pitch connector is increased, advantageously.

While a preferred embodiment in accordance with the present disclosure has been shown and described, equivalent modifications and changes known to persons skilled in the art according to the spirit of the present disclosure are considered within the scope of the present disclosure as described in the appended claims. For example, to efficiently holding of the remaining post, the contour of the remaining post can be of an upside-down T configuration instead of the straight type. Also, in this embodiment because of the final pitch arrangement of the contacts, the upper linking part 242 should be offset from the junction 209 in the vertical direction for no interference therebetween for the two neighboring contacts. In addition, in this embodiment, the soldering section 25 extends from the secondary body 22 and the first linking part 211 is located on a bottom portion of the main body 21. Alternately, the soldering section 25 extends from the main body 21 while the first linking part 211 is located on the bottom portion of the secondary body 22. Similarly, the upper linking part 242 can be located on an upper portion of the secondary body 22 instead of the main body 21. Also, the retention tabs 212, 213 may be formed on the secondary body 22 instead of the main body 21. Generally speaking, the main body 21 and the secondary body 22 can be deemed as one body portion extending in two planes angled with each other. In this embodiment, the lower carrier 201 originally includes the transversely extending crossbar integrating the corresponding remaining posts 2011 together. Understandably, the transversely extending crossbar may stabilize the respective contacts during stamping and forming the respective contacts. Anyhow, in an alternate inferior embodiment, the lower carrier 201 may include only the posts 2011 linked to the corresponding lower linking part 211 without the transversely extending crossbar when the whole contact assembly is formed so as to allow such a contact assembly to be directly assembled into the corresponding passageways 11 without additional step of removing the transversely extending crossbar of the lower carrier. From a technical viewpoint, the upper linking part and the lower linking part are preferred to be formed on the body portion where the retention tabs are located for achieving the efficient mechanical force arrangement. In this embodiment, both the upper carrier and the lower carrier are originally unitarily formed with the contacts for easy and efficient forming the whole contact assembly. Alternately, the upper carrier may be discrete from the contacts with an attachable manner if the contacting section is enlarged and the material of the contacts and that of the upper carrier may interfere with each other.

Similar to the previous embodiments, the feature of this embodiment disclosed in FIGS. 21-31 is to provide a method of assembling a plurality contacts 20 into the passageways 11 of the housing 10 via the respective carriers 201 which are discrete from one another and grasped by an external tool or fixture to apply the downward forces upon the corresponding contacts 20 to efficiently downwardly move toward the housing 10 and into the passageways 11 until reaching their final positions in the vertical direction. The carriers 201 are removed from the corresponding contacts after the contacts 20 are retainably assembled within the corresponding passageways 11. Understandably, the carriers 202 are required to be removed from the corresponding contacts 20 either after the contacts 20 are completely positioned at their final positions in the housing 10 or before, as long as the carriers 201 are already grasped by the external tool for downward moving. Therefore, compared with the previous embodiments as shown in FIGS. 1-10(B) in which the carriers 110/210 adapted to be retained to the fixture 10 are originally linked on upper portions of the contacts 100/200, in this embodiment as shown in FIGS. 21-31 the carriers 201 adapted to be retained by an external fixture for holding are originally linked to lower portions of the contacts differently. Anyhow, disregarding where such a carrier is located relative to the corresponding contact, the assembling method is essentially same by using an external fixture to retain thereon the respective carriers which are discrete from one another but respectively originally connected to the corresponding contacts so as to initially have a downward force applied upon the carrier and the corresponding contact to downwardly move and assemble the contact into the corresponding passageway, and successively remove the carrier from the corresponding contact.

What is claimed is:

1. A method of making an electrical connector comprising steps of:

providing an insulative housing with a plurality of passageways extending therethrough in a vertical direction;

providing a plurality of contacts with corresponding carriers unitarily formed thereon, respectively, wherein the carriers are discrete from one another;

providing an external fixture to commonly retain the carriers thereon;

downwardly moving the fixture to have the contacts simultaneously assembled into the corresponding passageways, respectively; and detaching the carriers from the corresponding contacts, respectively;

wherein the carrier is originally connected to a lower portion of the corresponding contact as a lower carrier;

an upper carrier is originally connected to an upper portion of each corresponding contact, and said upper carriers of the contacts are unified together by a transverse bar;

before the lower carriers are pulled downwardly by the external fixture to move the corresponding contacts downwardly to reach final positions of the contacts in the vertical direction, the contacts are downwardly moved into the housing by said upper carriers; and the upper carriers are removed from the corresponding contacts, respectively, before the lower carriers are removed from the corresponding contacts, respectively.

2. The method as claimed in claim 1, wherein the contact has a main body, and both a spring arm and the corresponding carrier extend from an upper portion of the main body.

3. The method as claimed in claim 2, wherein each contact further includes a secondary body sidewardly linked to the main body, and a soldering section is formed on a bottom end of the secondary body.

4. An electrical connector made by the method as claimed in claim 1.

5. The electrical connector as claimed in claim 4, wherein the contact includes a planar body having an upper end originally connected to the corresponding carrier, and a lower end originally connected to another carrier which is removed after assembled.

6. A method of making an electrical connector, comprising the steps of:

providing an insulative housing with a plurality of passageways extending therethrough in a vertical direction;

providing a row of contacts with respective discrete carrier posts unitarily connected to one end thereof and with a second carrier unitarily connected to an opposite end thereof;

retaining the discrete carrier posts by an external fixture;

moving the external fixture to simultaneously insert the contacts to final positions in the corresponding passageways after removing the second carrier; and removing the carrier posts from the corresponding contacts.

* * * * *